US006439744B1

(12) United States Patent
Chanslor

(10) Patent No.: US 6,439,744 B1
(45) Date of Patent: Aug. 27, 2002

(54) DECORATIVE GROUND LIGHTING STAKE ASSEMBLY AND SYSTEM

(75) Inventor: Lewis P. Chanslor, St. George, UT (US)

(73) Assignee: Yard-Lites, Inc., St. George, UT (US)

( * ) Notice: Subject to any disclaimer, the term of this patent is extended or adjusted under 35 U.S.C. 154(b) by 0 days.

(21) Appl. No.: 09/702,282

(22) Filed: Oct. 30, 2000

Related U.S. Application Data

(63) Continuation-in-part of application No. 09/505,817, filed on Feb. 17, 2000, which is a continuation-in-part of application No. 09/165,752, filed on Oct. 2, 1998, now abandoned.

(60) Provisional application No. 60/061,108, filed on Oct. 3, 1997.

(51) Int. Cl.[7] ..... F21V 21/08

(52) U.S. Cl. ..... 362/249; 362/414; 248/511; 248/530

(58) Field of Search ..... 362/153, 190, 362/191, 249, 391, 392, 393, 431, 806, 145, 152, 810, 414; 248/571, 530, 156, 71, 51, 74.1, 74.2, 74.3, 511

(56) References Cited

U.S. PATENT DOCUMENTS

| | | | | | |
|---|---|---|---|---|---|
| 3,758,062 | A | | 9/1973 | Caldwell et al. | 248/156 |
| 3,866,034 | A | * | 2/1975 | Russo | |
| 4,774,648 | A | * | 9/1988 | Kakuk et al. | |
| 4,858,877 | A | | 8/1989 | Carter | 248/545 |
| 4,996,636 | A | | 2/1991 | Lovett | 362/431 |
| 5,036,447 | A | * | 7/1991 | Taylor | 248/156 |
| 5,055,987 | A | * | 10/1991 | Ellson et al. | 362/145 |
| 5,062,028 | A | | 10/1991 | Frost et al. | 362/183 |
| 5,178,454 | A | * | 1/1993 | Lai | 362/153 |
| 5,481,444 | A | | 1/1996 | Schultz | 362/249 |
| 5,504,397 | A | * | 4/1996 | Chien | 248/51 |
| 5,526,243 | A | | 6/1996 | Masters | 362/122 |
| 5,570,952 | A | * | 11/1996 | Protz, Jr. | 248/156 |
| 5,597,229 | A | | 1/1997 | Plichta et al. | 362/153.1 |
| 5,639,057 | A | | 6/1997 | Yeomans | 248/530 |
| 5,667,174 | A | | 9/1997 | Adams | 248/156 |

* cited by examiner

*Primary Examiner*—Sandra O'Shea
*Assistant Examiner*—Ismael Negron
(74) *Attorney, Agent, or Firm*—Workman, Nydegger, Seeley

(57) ABSTRACT

A decorative lighting system for deploying a string of decorative lights above a ground surface, includes (i) a string of decorative lights comprising a plurality of electrical sockets each connected by wiring strung between each of the sockets, each socket receiving a light bulb; and (ii) a plurality of separate stakes configured to hold the plurality of sockets. Each stake includes (i) a sharpened end to facilitate driving the stake through the ground surface and into the ground to a desired depth; (ii) a receptacle that removably receives an individual socket therein, and (iii) a slot that removably seats and secures said wiring, the slot located adjacent the sharpened end such that said wiring extends from the socket on said string of lights located at the receptacle, through a body of the stake and into slot, wherein the sharpened end comprises an insertion member disposed below the slot such that the insertion member is placed into the ground surface with the wiring above the ground surface.

18 Claims, 14 Drawing Sheets

DECORATIVE GROUND LIGHTING STAKE ASSEMBLY AND SYSTEM

PRIORITY DATA

This nonprovisional patent application is a continuation-in-part of a nonprovisional patent application filed Feb. 17, 2000, Ser. No. 09/505,817 entitled "DECORATIVE GROUND LIGHT STAKE ASSEMBLY AND SYSTEM," to Lewis P. Chanslor, which is incorporated herein in its entirety by reference, and which is a continuation-in-part of a nonprovisional patent application filed Oct. 2, 1998, Ser. No. 09/165,752 now abandoned, entitled "DECORATIVE GROUND LIGHTING SYSTEM," to Lewis P. Chanslor, which is incorporated herein in its entirety by reference and which claims priority to a provisional patent application filed in the United States Patent and Trademark Office on Oct. 3, 1997 and having an application Ser. No. of 60/061,108 entitled "CANDLESTICK LIGHT-HOLDERS" to Lewis P. Chanslor, which is also incorporated herein in its entirety by reference.

BACKGROUND OF THE INVENTION

1. Field of the Invention

This invention is in the field of lighting systems. More specifically, this invention is in the field of decorative ground lighting systems.

2. The Relevant Technology

Outdoor lighting is a popular way to decorate homes and provide illumination for dark walkways. Typical outdoor lighting includes holiday lights, commonly known as Christmas lights or other such holiday lights. While such lights often bring great pleasure and excitement to those viewing the lights, the lighting systems tend to be cumbersome and time consuming both to install and to maintain.

For example, certain lighting systems include clips which must be fastened to a roof, tree, pole, railing or other structure in order to mount the lighting systems outdoors. In addition, after finding the location to mount each individual clip, and mounting each clip, it is possible for one or more lights to fail. Often, if even a single light fails or "burns out" an entire strand of lights must be replaced. Replacing the entire strand of lights can mean removing the strand from its clipped location, then reclipping each of the new lights at the same location.

Even with lights which do not burn out, such clipped lights tend to fall from their locations, potentially subjecting the lights to damage and at the very least exhibiting an unsightly appearance. Lights which are placed onto or fall onto the ground without any additional support can be stepped on and crushed.

Other outdoor lighting systems feature a series of ground mounted holders or stakes having light bulbs and electrical cords extending therethrough or otherwise coupled thereto. The holders and bulbs, with their accompanying electrical cords are typically installed as a single, combined unit. Installation of such combined units often involves pressing the holders into the ground or digging a hole, installing the holders, then covering a portion of the holders with dirt or other material.

Since the holders, bulbs, and cords are installed as a unit, it is possible for the bulbs of such units to be broken during such installation or for the electrical cords to be sliced or otherwise damaged. For example, a delicate bulb can be broken while the unit is pressed into the ground. Such damage to the bulbs or cords can result in the loss of electricity to a single unit or to an entire lighting system comprising a series of units. Furthermore, the exposing or uncovering of live electrical wires during installation can present a potentially precarious scenario.

Replacement or repair of such combined units also typically requires removal of both the holder and the accompanying bulb and electrical cord. In the event units are permanently coupled in a series, the entire lighting system of a garden or yard, for example, must be removed. This can require both a great deal of time and labor to dig up previously implanted units. In addition, the removal of such combined units can damage delicate electrical systems.

Furthermore, certain receiving ends of typical light holders or stakes are configured for receiving only specially designed light fixtures, rather than a variety of different light fixtures currently on the market. Other light holders feature complicated upper receiving portions which are both expensive to manufacture and form a top heavy structure when placed into the ground.

Moreover, certain light-holding stake systems require the twisting or bending of the light fixture in order to couple the fixture to the receiving end of the stake. In addition to the placement of the light fixtures onto the receiving end of the stake, removing the light fixtures from the receiving end also requires such twisting or bending.

Pieces of small plastic pipe have been cut into one foot sections and inserted into the ground at approximately one foot intervals with Christmas lights clipped to the side at the top. However, the pieces failed to adequately hold the lights in a stable manner and exhibited an unsightly appearance.

Ground-mounted light-holding stakes can also be difficult to insert into the ground, such as in rough or rocky terrain. In addition, it is possible, upon insertion of the stakes, to damage the stakes, such as by damaging the tops of the stakes with a hammer or other tool.

OBJECTS AND BRIEF SUMMARY OF THE INVENTION

It is therefore an object of the invention to provide an improved decorative lighting system.

It is another object of the invention to provide a decorative lighting system including stakes which are separately deployable prior to stringing a string of decorative lights onto the stakes. It is another object of the invention to provide a decorative lighting system wherein a string of lights can by deployed by simply inserting each socket on the string of lights into a corresponding receiving end of a stake.

It is another object of the invention to provide a decorative lighting system including stakes which can hold a variety of different light fixtures.

It is another object of the invention to provide a stake for holding a light fixture which can conveniently hold light fixtures in rows with electrical cords of the light fixtures extending on opposing sides of the stake.

Another object of the invention is to provide a stake for holding a light fixture which has the actual appearance of a candlestick.

Another object of the invention is to provide a light stake which is conveniently inserted into the ground.

Yet another object of the invention is to prevent damage to a light stake upon insertion into the ground.

Another object of the invention is to provide a light stake which conveniently orients wires extending therefrom.

Another object of the invention is to provide a light stake assembly which is conveniently mounted into a ground surface.

The present invention relates to a decorative lighting system for deploying a string of decorative lights above a ground surface. The system includes (i) a string of decorative lights; and (ii) a plurality of separately deployable stakes. The string of lights comprises a plurality of electrical sockets. Each socket receives a light bulb and is connected by wiring strung between each of the sockets.

Each stake holds an individual socket and is separately deployable prior to stringing the string of decorative lights onto the stakes. Each stake comprises (i) a sharpened end to facilitate driving the stake through the ground surface and into the ground to a desired depth; and (ii) a receiving end having a receptacle formed therein.

The receptacle is sized to removably receive one of the sockets of the light string. The receiving end includes at least one and preferably first and second slots therein into which the wiring of the light string is removably seated and secured. Thus, the string of lights can by deployed onto the stakes by simply inserting each socket on the string of lights into a corresponding receiving end of a stake, and inserting the wiring of the string of lights into the at least one slot of that stake.

Consequently, the stakes can be installed separately from the string of lights, preserving electrical wires and bulbs until after the stakes have been pounded into or otherwise mounted within the ground. Stakes can be strategically placed in desired locations before attempting to place bulbs and wires in the stakes. This prevents damage to such electrical wires and bulbs during installation and during site location. The stakes can also be stored or washed separately from the electrical cords and bulbs of the light string. Furthermore, if a single light or even the entire lighting system fails or burns out, the stakes can be left in their strategic position while the light string is removed and conveniently replaced.

The first and second slots in the receiving end run from a top end of the receptacle to a point near a bottom end of the receptacle. The wiring is conveniently accommodated by the slots. The socket and wiring are merely placed into the receptacle and slots of the previously deployed stake without having to twist or bend the socket or wiring. This makes the system easily deployable in separate, distinct portions.

In one embodiment, the slots run from a top end of the receptacle to a point near the ground surface when the stake is driven into the ground. Next, a clip means is provided for removable attachment onto and around the stake to secure the wiring to the stake at the point near the ground surface. This places the wiring adjacent the ground, exhibiting a tidy appearance and preventing people and pets from tripping on the wiring. In another embodiment, the slot is located at the sharpened end of the stake.

Another embodiment of the invention comprises cord means for joining each stake to at least one adjacent stake at a predetermined distance from one another. Thus, the stakes are coupled together in an organized fashion.

The preferred embodiment of the stake comprises a length of hollow pipe. Thus, the stake is lightweight and inexpensive to manufacture. The stake has no moving parts, is made from readily available and inexpensive materials and can be readily molded as a unitary body on a mass production basis. Optionally, however, the stake can be made from fairly commonly available pipes found in hardware stores and other retail and wholesale establishments. Such pipes can be cut into the desired lengths, after which one end of the pipe is slotted with opposing parallel slots and another end is cut with a slant cut.

The stake of the present invention is also convenient to place into or remove from the ground. Once the stakes are placed in the ground, the user then presses a light fixture into the receiving end. No twisting or bending of the fixture is required.

Yet another advantage of the stakes of the present invention is that the stakes can accommodate light fixtures having a clip thereon as well as light fixtures lacking clips. In one embodiment, for example, a clip coupled to the socket of a light fixture extends over the top of the rim of the receiving end of the stake of the present invention. In another embodiment, the receiving end is sized such that the clip is positioned within the open receiving end.

Examples of light fixtures held above a ground surface include Christmas lights or other light fixtures comprising a socket and an electrical cord coupled to the socket. The light bulb of the fixture may be removably or integrally coupled to the socket.

Upon placing a light into the receiving end of the invented stake, the system yields the appearance of an electrically lighted candlestick. One embodiment of the invention is thus a decorative lighting holder device which accommodates strings of white outdoor Christmas lights to simulate electrically lighted candlesticks.

Furthermore, the system of the present invention can be employed to maintain a variety of different light fixtures ranging in size from miniature to intermediate to large lights above the ground. In addition, since the stakes and light strings are separately deployable, they can be separately stored and separately shipped. Thus, the electrical wires of the light string do not become entangled with the stakes.

Yet another embodiment of the invention comprises a decorative lighting stake assembly which maintains at least one decorative light above a ground surface. The decorative lighting stake assembly may comprise, for example: (i) a holder configured to selectively hold at least one decorative light therein; and (ii) a stake selectively, removably coupled to the holder. The stake selectively couples the holder to the ground surface. The stake is separately deployable from the holder prior to coupling the holder to the stake.

Thus, in use, the stake is selectively driven partially into the ground surface, after which the holder is selectively coupled to the stake. The stake has a first end and a second end. The first end is configured to be inserted into the ground surface to a desired depth and the second end is configured to be coupled to the holder. The holder has a receiving end which selectively, removably receives a portion of at least one individual light therein, so that at least one light is selectively deployed by inserting a portion of the light into the receiving end.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
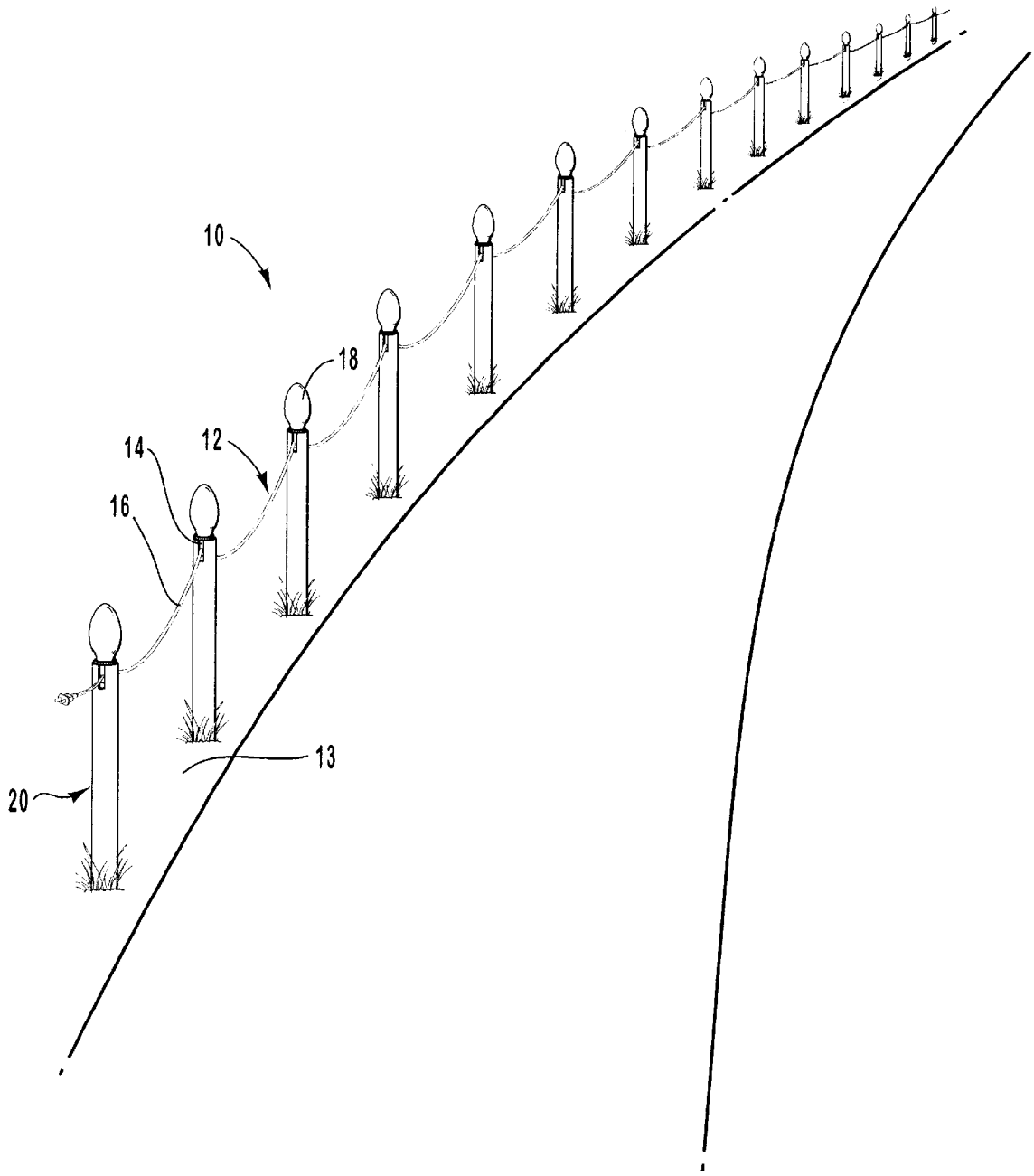
FIG. 1 is a perspective view of a decorative ground lighting system of the present invention disposed adjacent a lane or sidewalk, simulating the effect of a variety of different candles disposed along the lane or sidewalk.

An embodiment of a decorative lighting system 10 for deploying a string 12 of decorative lights above a ground surface 13 is shown in FIG. 1. System 10 comprises a string 12 of lights comprising a plurality of electrical sockets 14. Each socket 14 is connected by wiring 16 strung between each of the sockets 14. Each socket 14 receives a light bulb 18.

System 10 further comprises a plurality of separate stake means for holding the plurality of sockets 14. Each stake means holds an individual one of said sockets 14 and is separately deployable prior to stringing string 12 of decorative lights onto the stake means. Since each stake means is separately deployable, it is possible to initially deploy the stake means, then place the light string, 12 thereon. This can make installation significantly more convenient because the user is not limited by wiring 16 and bulbs 18 during installation of the stake means. Optionally, the string 12 of lights can be removed while the stake means remains in the ground, in the case of inclement weather or replacement, for example.

Figure 2:
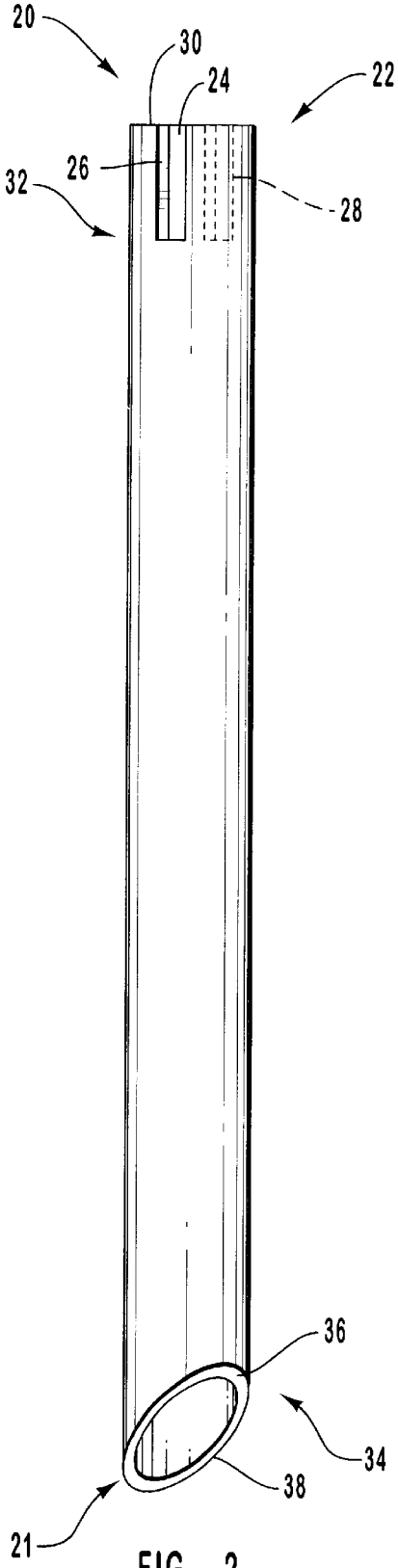
FIG. 2 is a perspective view of a stake for holding a light fixture of the present invention.

With reference now to FIGS. 1 and 2, stake 20 is one example of structure which performs the function or a stake means for holding sockets 14. Stake 20 comprises (i) a sharpened insertion end 21 to facilitate driving stake 20 through the ground surface 13 and into the ground to a desired depth; and (ii) a receiving end means for removable insertion of an individual socket 14 therein. Receiving end 22 at the upper end of stake 20 is one example of such a receiving end means for removable insertion of socket 14.

Receiving end 22 comprises a receptacle 24 formed on an upper end of stake 20 which is sized to removably receive one of the sockets 14 of light string 12. For example, in one embodiment, receptacle 24 is sized to receive a socket 14 of light string 12 in a friction fit manner.

Receiving end 22 also includes means for removably seating and securing wiring 16 so that string 12 of lights can by deployed by simply (i) inserting a socket 14 of string 12 into receiving end 22; and (ii) inserting wiring 16 of string 12 into the means for seating and securing the wiring at receiving end 22.

One example of a structure for performing the stated function of a means for removably seating and securing wiring 16 comprises at least one and preferably first and second opposing slots 26, 28 running from a top end 30 of said receptacle 24 to a point near a bottom end 32 of receptacle 24.

Wiring 16 of light string 12 is removably seated and secured so that light string 12 can be deployed by simply inserting each socket 14 of light string 12 into a corresponding receiving end 22 of stake 20 and inserting wiring 16 of light string 12 into at least one slot 26, 28. Slots 26, 28 are parallel to each other, as shown in the side view of FIG. 2. In the event a single slot is employed, both ends of the wiring can extend from the single slot.

In light of the configuration of system 10, stakes 20 can be installed separately from string 12 of lights, preserving electrical wires and bulbs until after stakes 12 have been mounted within ground. Stakes 20 can be strategically placed in desired locations before attempting to place sockets 14 and wiring 16 in stakes 20. This prevents damage to electrical wires bulbs during installation and during site location. Stakes 20 can also be stored or washed separately from wiring 16 and bulbs 18. Furthermore, if a single light or even the entire lighting system fails or burns out, stakes 20 can be left in their strategic position while light string 12 is removed and conveniently replaced.

Figure 4:
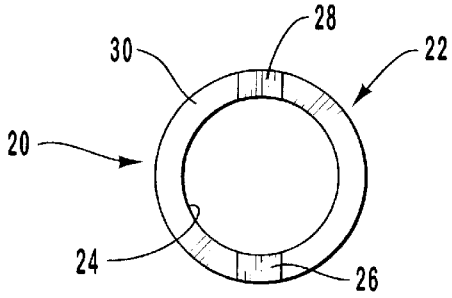
FIG. 4 is a top view of the stake of FIG. 2.
Figure 3:
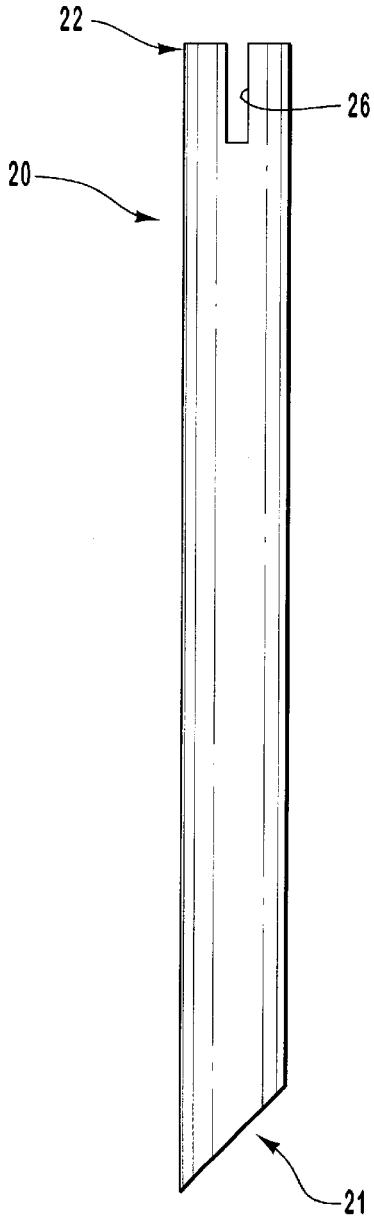
FIG. 3 is a side view of the stake of FIG. 2.

As shown in FIGS. 2–4, in one embodiment stake 20 preferably comprises a pipe which is sized large enough to allow insertion of the base of a light to be inserted at the top or receiving end 22 of the pipe, wherein receiving end 22 is slotted on either side to provide a place for the electrical wire of a continuous string of lights to enter one side and exit on the opposite side.

Stake 20 preferably comprises a length of hollow pipe having a cylindrical body 34. Body 34 has a longitudinally extending tubular wall extending between upper end 30 of receptacle 24 and a bottom rim 38 of insertion end 21. In another embodiment, however, insertion end 21 and the remainder of body 34 up to the bottom 32 of receptacle 24 constitute a solid piece with receiving end 22 being hollow to receive a socket. Nevertheless, entire body 34 of stake 20 is preferably a hollow cylindrical body 34 such that stake 20 is lightweight and inexpensive to manufacture. For strength and convenience in manufacturing, body 34 is preferably a unitary body.

Bottom rim 38 of insertion end 21 is oriented at an angle with respect to the longitudinal axis of cylindrical body 34, forming a sharpened tip for enabling insertion end 21 to be conveniently inserted into the ground surface. Although the angle of rim 36 is preferably 45°, any angle forming a sharp, slanted tip that is suitable for the purpose or allowing end 21 to be inserted into the ground may be employed.

With reference now to FIG. 4, body 34 of stake 20 has a generally uniform circular cross sectional configuration. Since stake 20 is an elongate cylindrical member having a generally continuous cross sectional configuration, stake 20 is stable. The preferred hollow nature of stake 20 also assists in making stake 20 light and inexpensive to produce. Also in light of the hollow configuration of stake 20, stake 20 can be made from fairly common products, including polyvinyl chloride ("PVC") plastic pipes, or other pipes found commonly in hardware stores and other retail and wholesale establishments. Such pipes can be readily cut into the desired lengths, after which one end of the pipe is slotted with opposing parallel slots 26, 28 and another end 21 is sharpened by being cut with a slant cut, as shown.

Figure 5:
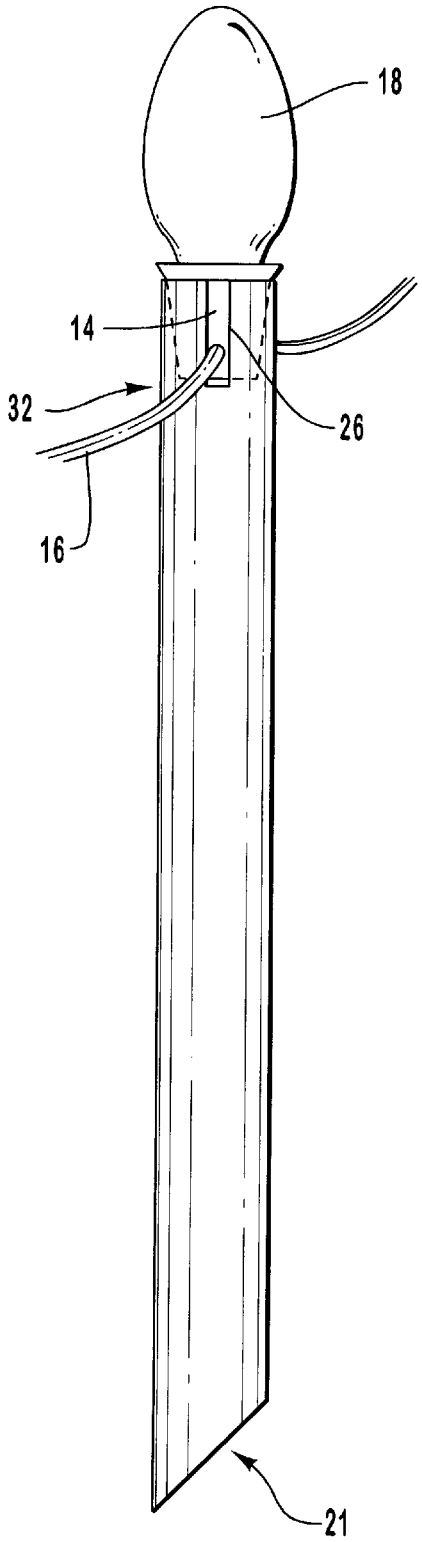
FIG. 5 is a side view of a stake of FIG. 2 holding a light fixture.

With reference now to FIG. 5, a socket 14 is shown as being positioned in receiving end 22 of stake 20. Bulb 18 may be integrally received within socket 14. Optionally, however, bulb 18 is removable from socket 14 and is replaceable.

Figure 6:
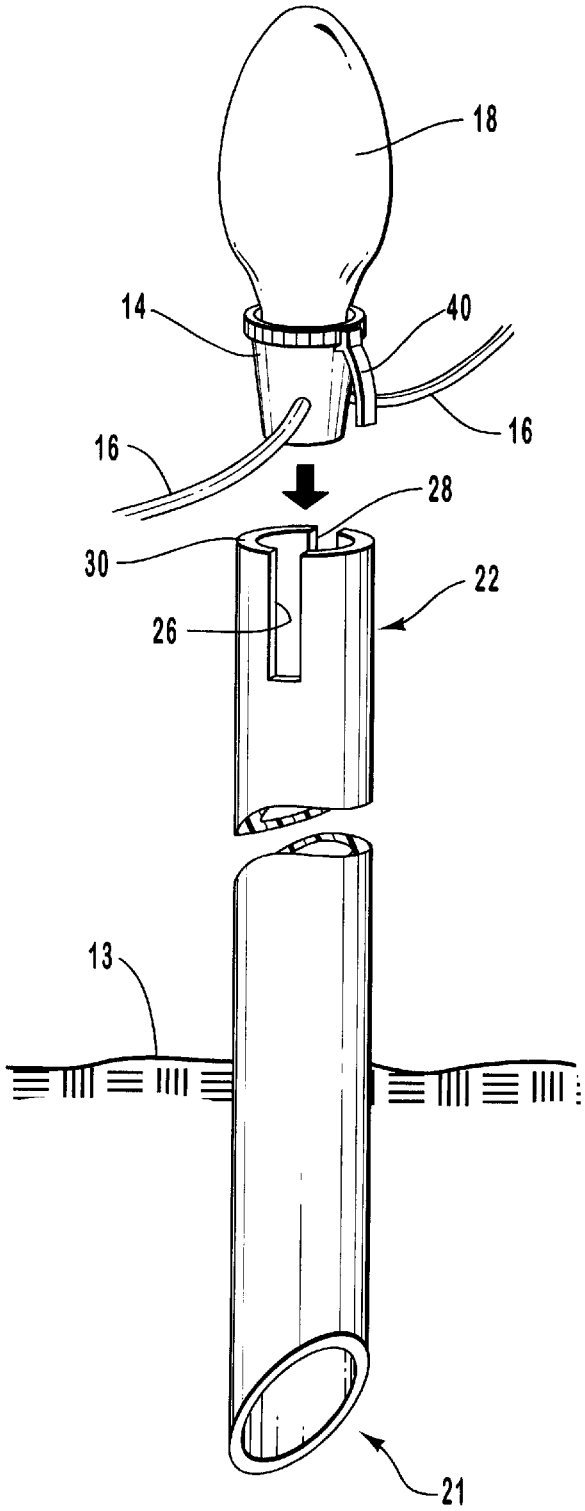
FIG. 6 is an exploded, cut away view of a decorative ground lighting system disposed within a ground surface.

As shown in FIG. 6, yet another advantage of the stakes 20 of the present invention is that the stakes 20 can accommodate sockets 14 having a clip 40 thereon as well as sockets lacking clips. In one embodiment, for example, a clip 40 coupled to socket 14 selectively extends over the top 30 of receptacle 24. In another embodiment, receiving end 22 is large enough that clip 40 is positioned within the interior of receptacle 24.

Also as shown in FIG. 6, socket 14 is conveniently inserted into receiving end 22 by aligning opposing ends of electrical cord 16 within longitudinally oriented slots 26, 28 and by moving socket 14 downward within receiving end 22. Socket 14 is also readily retracted from longitudinal slots 26, 28 by merely pulling socket 14 upward. Thus, longitudinal slots 26, 28 assist in making the insertion and retraction of socket 14 convenient and efficient.

Stake 20 is readily placed into ground either before or after socket 14 has been placed therein. The ground may be any support surface capable of receiving stake 20 and maintaining stake 20 in an upright position, such as dirt, grass, gravel, garden areas, or a permeable material, such as a foam or cushioned material capable of receiving stake 20 and maintaining stake 20 in an upright position.

FIGS. 2–5 show a basic view of stake 20. In one embodiment, stake 20 is made of a single piece of thick-wall schedule 40-PVC ¾ inch or ½ inch pipe approximately 12 inches in length wherein the bottom end of the pipe is cut on a 45 degree angle to provide ease of insertion into the ground and the top end has a ¼ inch slot which extends through both walls of the pipe to allow a continuous string of large base outdoor Christmas lights to be inserted base down with the bulb pointed straight up.

In addition, as shown in FIGS. 1 and 5, the configuration of stake 20 simulates that of a candlestick such that stake 20 can be employed as an elegant decorative piece. For example, when stakes 20 are inserted into the ground in a continuous row, (approximately 11 inch centers) with white (or colored) decorative Christmas lights inserted, they form a very attractive and stimulating yard decoration.

Stakes 20 may be sold separately or as a packaged set comprising a number of different stakes. By way of illustration, a packaged set of stakes 20 may include 25, 30, 50, or 100 stakes 20 to accommodate strings of numerous outdoor Christmas lights, for example.

Figure 7:
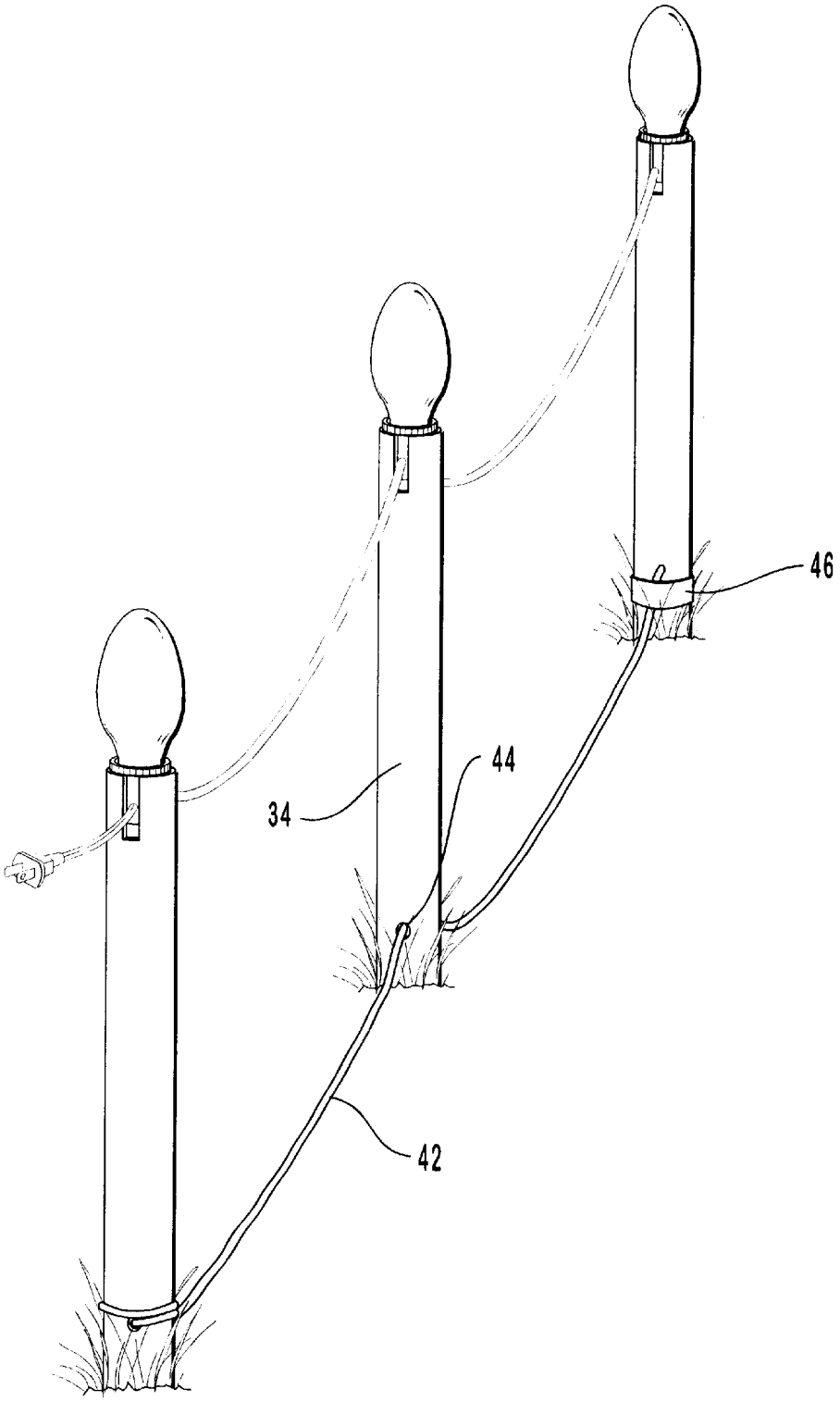
FIG. 7 is a perspective view of a series of stakes of the present invention shown as being coupled together in an organized fashion.

Stakes 20 may be hooked in series as is the case with regular Christinas lights, depending upon voltage limitations and used to line walk-ways, yard perimeters, driveways, etc. For example, as shown in FIG. 7, two or more stakes 34 may be hooked together through the use of a cord coupled to stakes 20. A variety of different stakes 20 may have a cord 42 coupled thereto, forming a string of stakes 20. Stakes 34 may be coupled by having a cord 42 extending through an aperture 44 in body 34 for example, or through the use of an adhesive or mechanical fitting, such as a clamp 46 coupled to a given stake 34 for example. Cord 42 is an example of cord means for joining each stake to at least one adjacent stake at a predetermined distance from one another. Cord 42 keeps stakes in a group preventing loss and providing convenience storage.

Figures 8A, 8B:
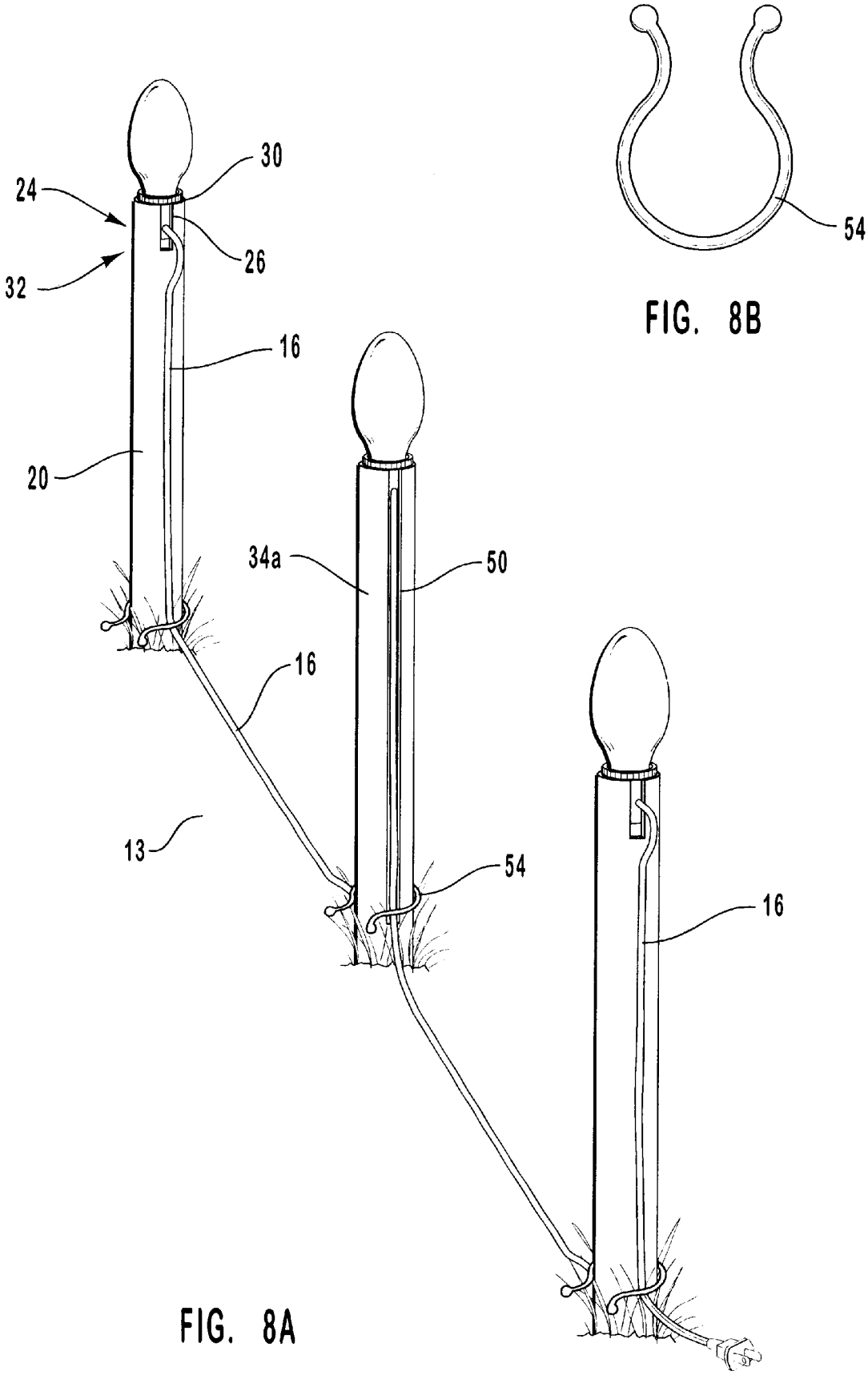
FIG. 8*a* is a perspective view of a decorative ground lighting system of the present invention featuring a clip of the present invention coupling wiring to stakes adjacent the ground surface in order to prevent individuals from tripping on the wiring.
FIG. 8*b* is an example of a clip which can be employed for removably coupling wiring to stakes.

With reference now to FIGS. 8*a* and 8*b*, another example of a means for removably seating and securing wiring 16 comprises at least one and preferably first and second slots 50 running from a top end 30 of receptacle 24 to a point near ground surface 13 when stake 34*a* is driven into ground surface 13. Wiring 16 fits elegantly into slot 50 such that wiring 16 is not exposed along the body of stake 34*a*.

A clip means such as removable clip 54 or another clip may also be provided for removable attachment onto and around stake 34*a* to secure wiring 16 at a point near ground surface 13. Clip 54 maintains a portion of wiring 16 within slot 50 near ground surface 13 and ensures that the wiring disposed on ground does not trip an individual or pet.

In another embodiment, also as shown in FIG. 8*a*, a slot 26 such as discussed with reference to FIG. 2 extends to a point near a bottom end 32 of receptacle 24. Wiring 16 extends from slot 26 and clip 54 maintains wiring 16 against the body of stake 20 near ground surface 13.

There are many potential applications for system 10, such as Christmas, Halloween, weddings, special occasion party lights, and other variations. Stakes 20 offer a new, inexpensive variation to holiday yard decor which is unique. Decorative lights may also have a variety of different functional uses.

While the above description contains several specificities, these should not be construed as limitations on the scope of the invention, but rather as an exemplification of one preferred embodiment thereof. Many other variations are possible. For example, other sizes to accommodate smaller or different sizes of decorative light strings or custom made lights.

The candlestick could also be fitted with a supportive base for other sized indoor or outdoor type lighting, with other outdoor or indoor applications. Another variation may be a two part unit which has a metal spiked base which is first inserted into the ground, which has a receiver socket into which the plastic pipe is inserted. It may also prove to be economically marketable to custom make units with integrated lights (built in) to hide the wires going from one candlestick to the next by slotting the units at the bottom rather than at the top end thus having the wires at ground level rather than on the upper end.

Accessory items may also include an implement which fits into the top of the candlestick to prevent damage when inserting into very hard or partially frozen ground. All of the above would be, of course, dictated by market feasibility and cost of production.

Figure 9:
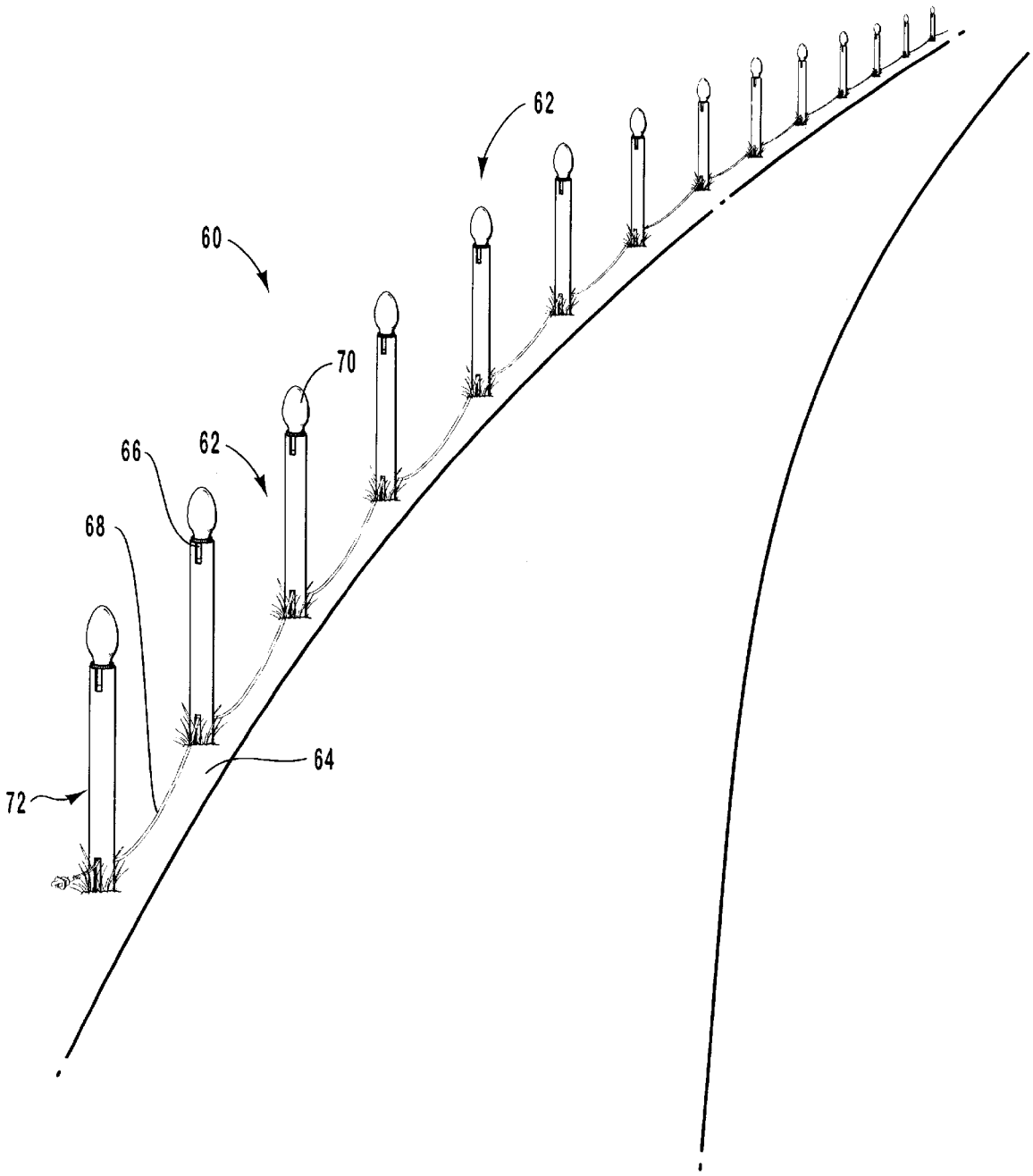
FIG. 9 is a perspective view of an alternative decorating ground lighting system of the present invention.

Another embodiment of a decorative lighting system 60 for deploying a string 62 of decorative lights above the ground surface 64 is shown in FIG. 9. System 60 comprises a string 62 of decorative lights 62 comprising a plurality of electrical sockets 66. Each socket 66 is connected by wiring 68 strung between each of the sockets 66. Note that wiring 68 is placed adjacent the ground surface 64 in FIG. 9, preventing tripping over a wire extending above the ground. This dynamic is achieved through the use of slots in the sharpened insertion end of the stakes 72, as discussed below.

Each socket 66 receives a light bulb 70. System 60 further comprises a plurality of separate stakes 72, which are examples of separate stake means for holding the plurality of sockets 66. Each stake 72 holds an individual one of said sockets 66 and is separately deployable prior to stringing string 62 of decorative lights onto tile stakes 72.

Figure 10C:
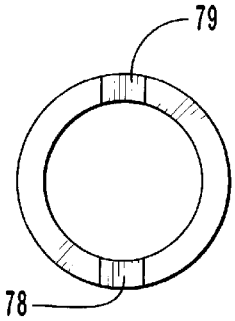
FIG. 10C is a top view of the stake of FIG. 10.
Figure 10:
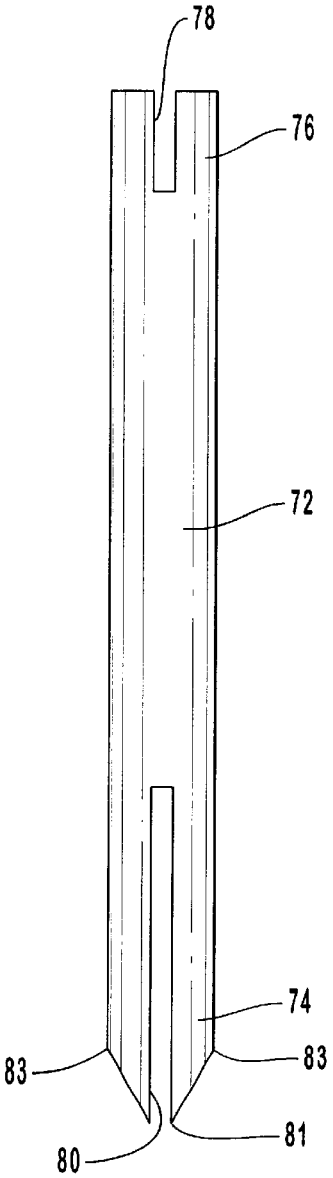
FIG. 10 is a perspective view of an alternative stake for holding a light fixture of the present invention.

With reference now to FIGS. 9 and 10, stake 72 is one example of structure which performs the function of a stake means for holding a decorative light. Stake 72 comprises: (i) a sharpened insertion end 74 to facilitate driving stake 72 trough the ground surface 64 and into the ground to a desired depth and, (ii) a receiving end 76. Receiving end 76 of stake 72 is an example of receiving end means for removably receiving a socket of a decorative light therein. As discussed above with respect to FIG. 2, in one embodiment, receiving end 76 comprises a receptacle which is sized to receive at least one light socket in a friction fit manner.

In another embodiment, receiving end 76 receives the light socket in a non-friction fit manner while a clip connected to the socket clips onto the receiving end, such as by seating within one of slots 78, 79. In yet another embodiment, receiving end 76 receives the socket in both a friction fit manner and by having a clip connected thereto. Stake 72 is preferably a hollow pipe.

As mentioned, receiving end 76 has at least one, and optionally first and second, slots 78, 79 (FIGS. 10, 10C) therein, each of which are examples of: (i) means for removably seating and securing wiring of a light fixture; and/or (ii) means for removably seating and securing a slip coupled to a socket. Stake 72 has a sharpened insertion end 74 which also has at least one and preferably first and second slots 80 on opposing sides thereof. As shown, slots 80 extend from the lower tip 81 of the sharpened end 74 upwardly along at least a portion of sharpened end 74. Also as shown, in the embodiment of FIG. 10, slots 80 extend above shoulders 83 can be driven into the ground while the wiring extends out of slots 80 and can remain above the ground. Slots 80 are additional examples of means for removably seating and securing wiring of a light fixture.

Figure 10A:
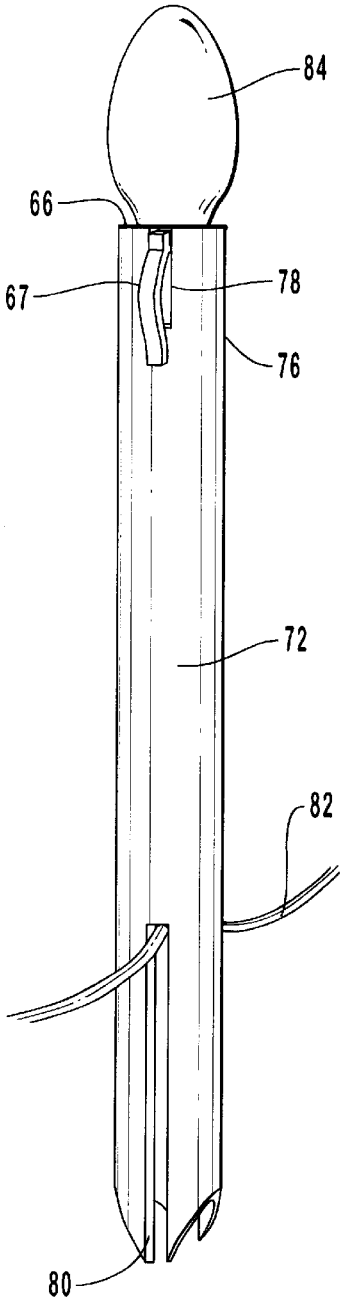
FIG. 10A is a view of the stake of FIG. 10 with a light fixture therein, wherein electrical wires of the light fixture extend out of slots in the sharpened insertion end of the stake.

As shown in FIG. 10A, in one embodiment, an electrical socket 66 is mounted within receiving end 76 while wiring 82 thereof is mounted within slots 80. The light of FIG. 10A comprises socket 66, wiring 82 coupled to socket and light bulb 84. According to one method of mounting socket 66 within receiving end 76, socket 66 is inserted through the hollow stake 72, beginning at the hollow sharpened insertion end 74, and continuing to insert socket 66 through stake 72 until socket 66 reaches receiving end 76, as shown in FIG. 10. Wiring 82 is then extended through slots 80. In one embodiment, once socket 66 is inserted from end 80 through stake 72 into receiving end 76, light bulb 84 is mounted in socket 66, leaving wiring 82 extending through slots 80. In another embodiment (such as when bulb 84 is not removable from the socket 66), bulb 84 remains in socket 66 while socket 66 is inserted through stake 72 into insertion end 74.

Once socket 66 is mounted in receiving end 76, stake 72 can then be driven into the ground surface by placing the sharpened insertion end 74 adjacent the ground surface and forcing the sharpened insertion end 74 into the ground surface, such that wiring extending from stake 72 is placed adjacent the ground surface.

As shown in FIGS. 9 and 10A, by employing slots 80 in sharpened insertion end 74, wiring of the decorative light can be placed adjacent the ground surface 64, preventing tripping over a wire extending above the ground 64. As shown in FIG. 9, in one embodiment, stakes 72 are driven sufficiently into ground surface 64 to maintain stakes 72 in an upright position, but allow a portion of slots 80 to remain above the surface such that wiring extends conveniently from stakes 72.

In the embodiment of FIG. 10A, clip 67 coupled to socket 66 is seated within slot 78, such that clip 67 maintains socket 66 in a desired position within receiving end 76. Wiring 82, then extends downwardly within the hollow stake 72 and extends out of opposing slots 80. It will be appreciated from FIG. 10A that it is possible to seat clip 67 within a single slot 78, such that only one such slot is necessary. However, a plurality of upper and/or lower slots may be employed.

Figure 10B:
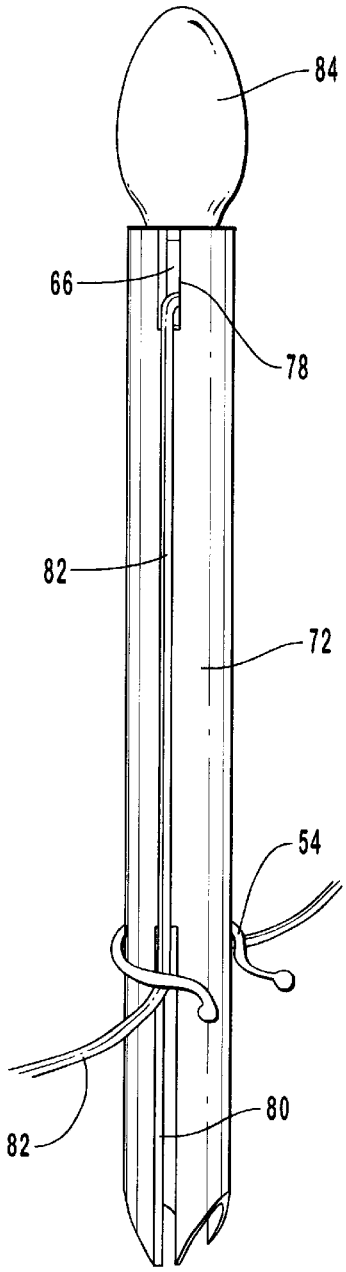
FIG. 10B is a example of a stake of the present invention holding a light fixture therein, wherein electrical wires of the light fixture extend down the side of the stake, have a portion thereof extending inside slots in the sharpened insertion end of the stake, and are coupled against the stake through the use of a clip.

In yet another embodiment, as shown in FIG. 10*b*, wiring 82 extends out of slots 78, 79 along the outside of stake 72 and into slots 80, such that clip 54 of FIG. 8*b* or another clip can conveniently maintain wiring 82 against stake 72 without pinching wiring 82 against the body of stake 72, but instead, maintaining wiring 82 within slot 80 at the connection point between stake 72 and clip 54.

Stake 72 can be manufactured according to a variety of different methods. According to one method, a hollow elongate member is provided with at least one slot 80 (and preferably first and second slots) formed in sharpened insertion end 74 of the elongate member. Lower end 74 can be sharpened before slots 80 are formed. Preferably, at least one, and possibly first and second slots ire also formed in an upper receiving end 76 of the hollow elongate member to form stake 72.

According to one method, a hollow elongate member is provided, at least one slot 80 (and preferably first and second slots) is formed in a lower end 74 of the elongate member, and the lower end 74 of the elongate member is sharpened to form the sharpened lower end 74 shown in FIG. 10. Lower end 74 can be sharpened before slots 80 are formed. Preferably, at least one, and possibly first and second slots are also formed in an upper receiving end 76 of the hollow elongate member to form stake 72.

Figure 11:
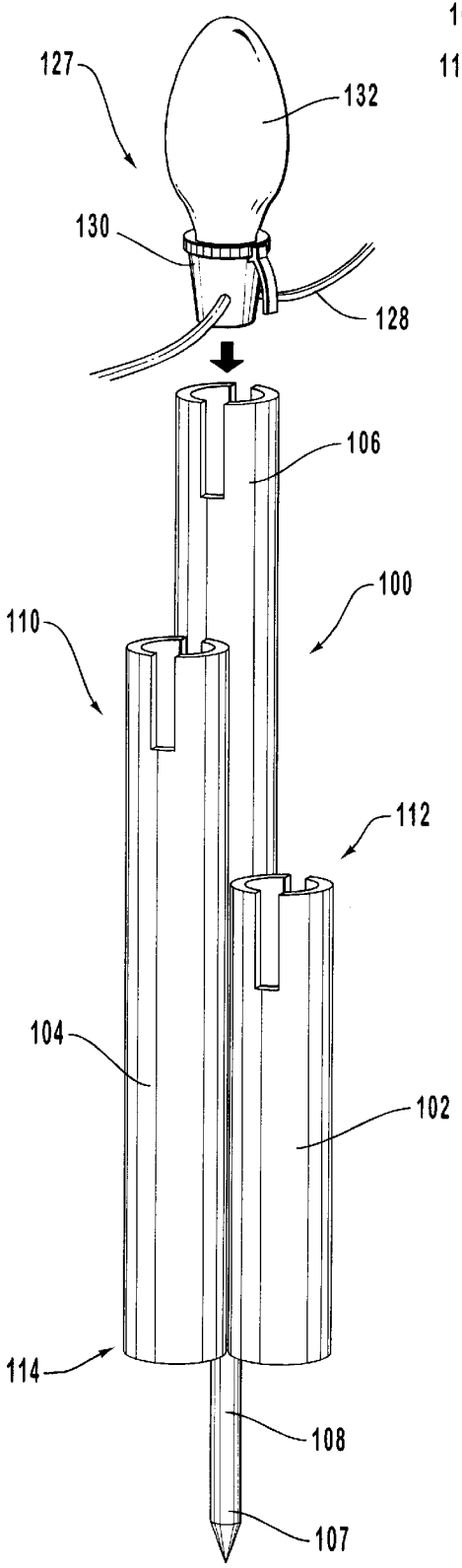
FIG. 11 is an example of a decorative lighting stake assembly of the present invention.

Another feature of the present invention relates to a decorative lighting stake assembly 100, an example of which is shown in FIG. 11. Assembly 100 is an example of a decorative lighting stake assembly for maintaining at least one decorative light above a ground surface.

Lighting assembly 100 comprises (i) a light fixture holder 110; and (ii) a stake 108 coupled thereto. Stake 108 is preferably selectively, removably coupled to holder 110. Holder 10 and stake 108 are selectively coupled in a mating relationship, e.g., by mounting holder 110 onto stake 108. In the embodiment of FIG. 11, holder 110 comprises a plurality of light fixture receiving members 102, 104, and 106 coupled together in an organized fashion. Receiving members 102, 104, and 106 form a clustered, triumvirate assembly which serves as a holder.

In the embodiment of FIG. 11, each receiving member 102, 104, and 106 comprises a length of hollow pipe having a cylindrically-shaped body. Each receiving member has an upper, receiving end, such that the overall holder 110 has a receiving end portion 112. The receiving end of each receiving member 102, 104, and 106 can be similar or identical to the receiving ends described above with reference to stake 20 or stake 72, for example. For example, the receiving ends of members 102, 104, 106 may each have at least one and possibly first and second slots therein.

Figure 12:
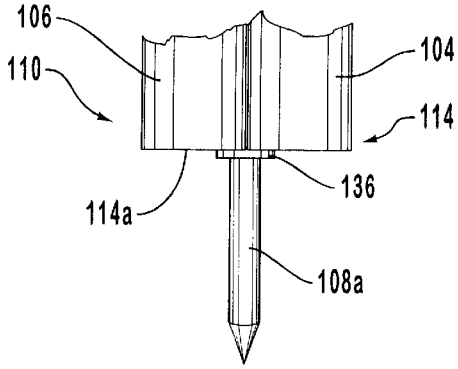
FIG. 12 is a view of yet another alternative embodiment of a decorative lighting stake assembly of the present invention, the assembly comprising the holder of FIG. 11 and a stake having a skirt member to retain the holder above the ground.

Each receiving members 102, 104, and 106 also has a lower end such that overall holder 110 has a lower end identified at 114. Lower end 114 may have a variety of configurations such as the flat configuration as shown in FIGS. 11 and 12. Optionally, at least one of the receiving members 102, 104, 106 has a sharpened insertion end configuration as shown in FIGS. 2–6 and FIG. 10–10*b*, or a variety of other configurations. The flat shape of the lower end 114 of holder 110 of FIG. 11 is advantageous in part because holder 110 can remain resting flat on a surface, such as within or outside a home.

FIG. 11 A demonstrates an advantage to coupling the cylindrically-shaped receiving members 102, 104, and 106 to each other in a triangular cross sectional configuration. As shown, the triangular cross sectional configuration of FIG. 11A defines a hollow, triangular shaped shaft 116 defined by the adjacent surfaces of the first, second, and third receiving members 102, 104, and 106. Shaft 116 selectively mates with stake 118. Thus, holder 110 has a hollow shaft 116, and stake 118 selectively fits into shaft 116.

One advantage of removable stake 108 is that stake 108 can be selectively driven into the ground separately from holder 110. Next, holder 110 can be mounted on stake 108 by placing shaft 116 over stake 108. By employing removable stake 108, a hammer or other device can be employed to insert stake 108, after which the holder 110 is selectively mounted thereon. By so mounting holder 110, holder 110 is not damaged by contact from the hammer or other device, Instead, the hammer or other device contacts stake 108, after which holder 110 is mounted on stake 108.

Figure 11A:
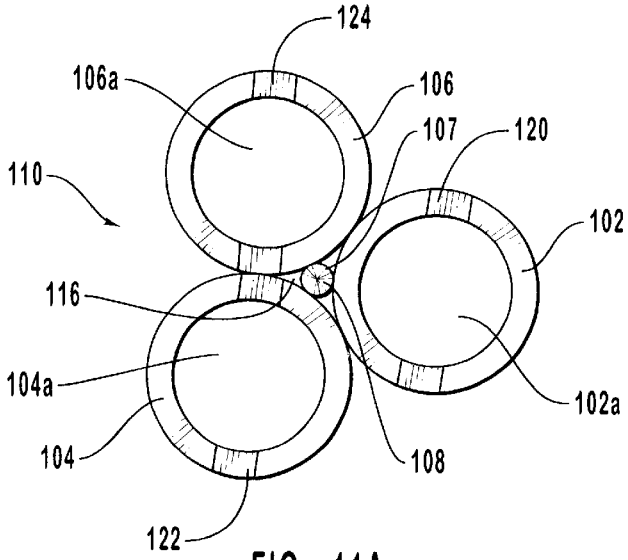
FIG. 11A is a top view of the assembly of FIG. 11.

Thus, stake 108 is separately deployable from holder 110 prior to coupling holder 110 to stake 108. In use, stake 108 is selectively driven partially into the ground surface, after which holder 110 is selectively coupled to stake 108. A first, lower end 107 of stake 108 is configured to be inserted into the ground surface to a desired depth and the second, upper end 109 is configured to be selectively coupled to holder 110, as shown in FIGS. 11 and 11A. A variety of different configurations of stakes can be employed to accomplish this selective coupling, including, for example, stakes which mate tightly within hollow shaft 116, stakes which fit into hollow shaft without a tight fit, but nevertheless retain holder 110 in an upright position, stakes having circular, square, rectangular, or triangular cross sections, for example, and a variety of other stakes which maintain holder 110 in an upright position. Optionally, a stake has a receiver socket into which a holder such as a holder 110 or another holder (e.g., holding a single light) is inserted.

Figure 11B:
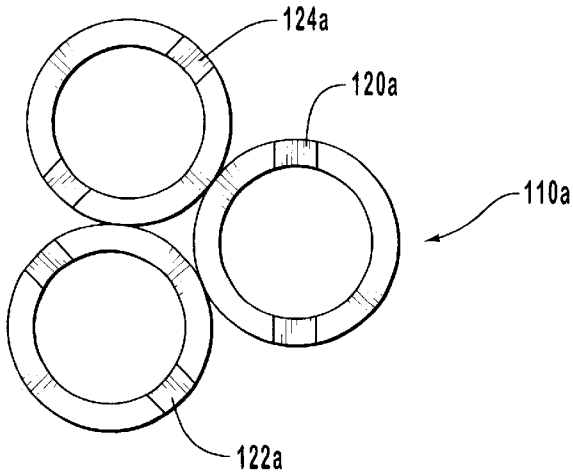
FIG. 11B is an alternative embodiment of a holder of the present invention.

In one embodiment, the slots 120, 122, and 124 of respective receiving members are arranged as shown in FIG. 11*a*. In other embodiments, slots 120*a*, 124*a*, and 122*a* of holder 110*a* are arranged as shown in FIG. 11B. Slots 120, 122, and 124 and 120*a*–124*a* selectively, removably receive wires 128 extending from sockets 130 or clips coupled to the sockets. Light bulbs 132 are coupled, optionally removably coupled, to such sockets 130. In yet another embodiment, one or more of the receiving members features only one slot. Such dual or single slots can be employed to seat one or two wires extending from a socket therein or to seat a clip of a socket therein.

Thus, one major advantage of assembly 100 is the ability to initially place a stake in the ground, then place stake 108 in the ground then place holder 110 thereon without risk of damaging either the holding assembly or the light fixtures 127, which is selectively removably placed into the various receiving ends of the respective receiving members 102, 104, and 106.

As shown in the embodiment of FIG. 11A, in one embodiment, the means for removably seating and securing wiring coupled to the light socket comprises a hollow shaft 102*a*, 104*a*, 106*a* extending through respective receiving members 102, 104, 106. Wiring can thus extend through shafts 102*a*, 104*a*, and/or 106*a* or may be placed in slots 120, 122, and/or 124, each of which are also examples of means for removably seating and securing wiring coupled to the light socket. Slots 120, 122, and/or 124 are also examples of means for removably seating and securing a clip coupled to a socket.

In one embodiment, wiring extends through at least one of shafts 102*a*, 104*a*, 106*a* and through at least one of slots 120, 122, 124. In this embodiment, the clips of the respective lights can be seated within the upper slots 120, 122, and/or 124, for example. Stake 108 is an example of stake means for selectively coupling holder 110 to the ground surface.

As shown, system 100 is also an example of a decorative lighting assembly for maintaining a plurality of decorative lights above a ground surface. Thus, holder 110 is an example of holding means for holding a plurality of decorative lights. Although it is possible to hold three lights with system 100, in another embodiment one, two, four, five, six, or more lights are held by a system having a stake removably coupled to a holder. Wiring 128 of system 100 may be coupled to a variety of different lights, which may also be maintained above a ground surface through the use of one or more additional systems 100 (or by a stake described herein, such as in FIGS. 2, 10, 14, or 21). Thus, a decorative lighting system for deploying a string of decorative lights above a ground surface may comprise one or more systems 100 for maintaining the lights above a ground surface.

The body of receiving members 102, 104, 106 has generally uniform circular cross sectional configuration in a preferred embodiment thereof. Members 102, 104, 106 are stable, light and inexpensive to produce. As shown, members 102, 104, 106 can have at least two different lengths and preferably three different lengths or possibly four, five or more different lengths, in order to provide lighting at varying heights and for an appealing appearance.

Holder 110 is an example of holding means for holding at least one decorative light. In one embodiment, holder 110 is formed through the use of adhesive to couple receiving members 102, 104, and 106 together. Optionally, the receiving members can be integrally coupled, such as by forming holder 110 as a single integral unit. In another embodiment, holder 110 can be formed by binding individual receiving member together in a variety of other manners, such as through the use of a binding collar or strap extending about the receiving members.

Assembly 100 is a two-part unit having a variety of different advantages. For example, one advantage of assembly 100 of FIG. 11 is that it provides an aesthetically pleasing appearance and enables multiple lights to be held in a tight, vertically and horizontally offset configuration. Optionally, however, the lights at the receiving end of the holders may be more horizontally spaced from each other, such as by configuring the receiving ends to be more separated from each other.

Figure 12A:
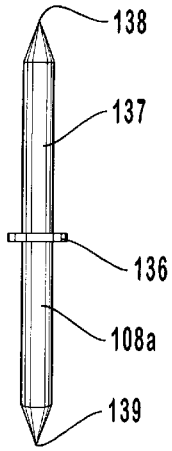
FIG. 12A is a view of the stake shown in FIG. 12.

In FIGS. 12 and 12A, an alternative stake 108*a* of the present invention is shown. Stake 108*a* comprises an elongate member 137 having a first, upper end 138, a second, lower end 139, and a skirt 136 located therebetween. Skirt 136 extends about at least a portion of elongate member 137, and preferably extends about the entire elongate member 137. Holder 110 is selectively mounted on skirt 136. Skirt 136 has a larger diameter than shaft 116, such that holder 110 rests on skirt 136.

FIGS. 11 and 12 also demonstrate that lower end 114 of holder 110 is flat, such that lower end 114 can be mounted on a support surface without the use of a stake, for example. Achieving a flat lower end 114 can be accomplished by employing flat lower ends on each of receiving members 102, 104, 106 and by positioning these flat lower ends adjacent to each other, as shown in FIGS. 11 and 12 in order to achieve an overall flat lower end 114. In a preferred embodiment, lower surface 114*a* of lower end 114 is transverse to the longitudinal axis of holder 110 such that lower surface 114*a* is readily mounted on a horizontal support surface while holder 110 is maintained in an upright, vertical position.

Stakes 108 and 108*a* are examples of spiked bases which are first inserted into the ground, after which a holder is mounted thereon. The stake and holder act as a convenient two-part unit. As another example of such a two-part lighting stake assembly comprising a stake selectively coupled to a holder, a stake has a receiver socket into which a holder such as a holder 110 or another holder (e.g., a single receiving member) is inserted.

A variety of different lights may be held by assembly 100

Figure 13:
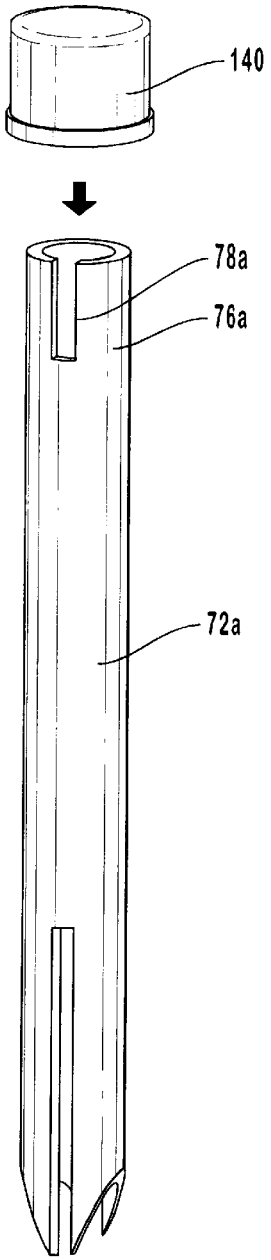
FIGS. 13 and 13A demonstrate the use of a cover to protect the top portion of a stake as the stake is driven into the ground.
Figure 13A:
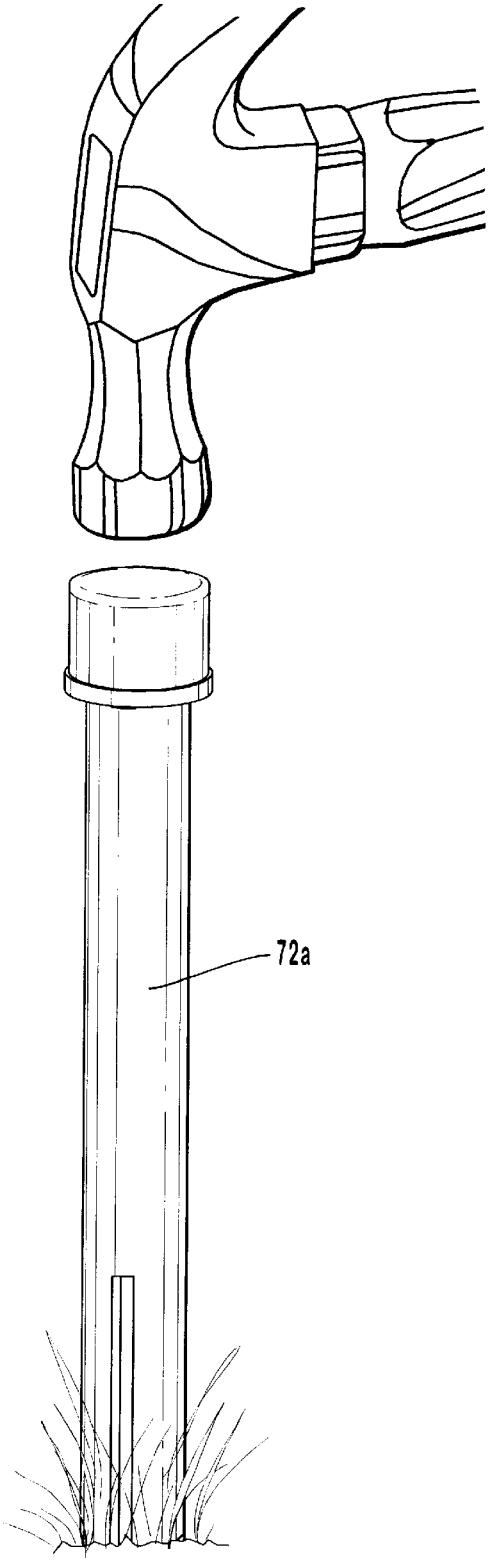
Figure 14:
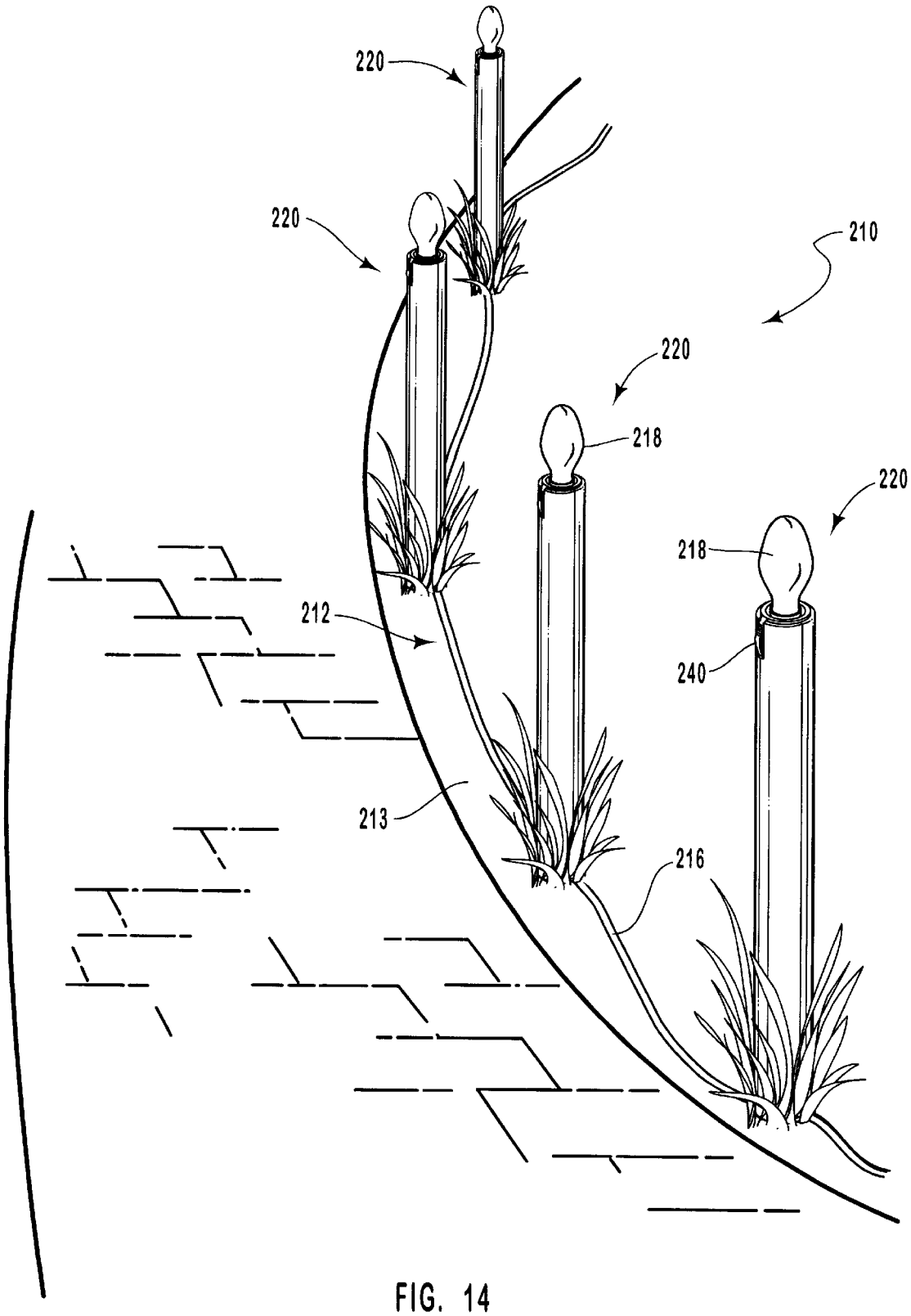
FIG. 14 is a perspective view of another decorative ground lighting system of the present invention.

FIGS. 13 and 13*a* demonstrate an example of means for covering a receiving end 76*a* of stake 72*a*, namely, a cover 140 having a hollow cavity therein. Cover 140 can be mounted on receiving end 76*a*, as shown in FIG. 13*a*. Next, a hammer or another tool is used to force stake 72*a* into the ground by contacting cover 140 rather than stake 72*a*. Thus, stake 72*a* is not damaged during insertion. Cover 140 can be provided in a variety of different embodiments and having different shapes. Cover 140 is configured to be mounted on top of receiving end 76*a* and is removably coupled thereto. Cover 140 is an example of an implement to prevent damage to a stake when inserting it into very hard or partially frozen ground. Cover 140 is configured to cover at least a portion of the receiving end 76*a* of stake 72*a* as stake 72*a* is driven into the ground.

As shown in FIG. 13 stake 72*a* has a single upper slot 78*a* for receiving wiring and/or a clip coupled to a socket, although cover 140 may be employed on a variety of different stakes disclosed herein such as stake 72, for example. Receiving end 76*a* of stake 72*a* is thus another example of receiving end means for removably receiving a socket of a decorative light therein.

According to one technique, stakes 20, 72, 72*a*, and assembly 100 of the present invention maintain lights with wires above a desired surface. According to another technique, however, stakes 20, 72, 72*a*, and assembly 100 maintain battery powered lights above a surface. Thus, power can be either AC or DC. For example, in one embodiment, a light socket having a battery therein is received within the receiving end 76 of stake 72. The socket received within the receiving end of a stake or receiving member of the present invention can thus be a socket coupled to a wire or a socket having a battery therein.

Thus, a battery powered light can be mounted within one or more of receiving members 102, 114, 106 of light fixture holder 110. Light fixture holder 110 can be mounted onto a support surface and stand upright without the use of stake 108 and receive such battery powered lights. Placing battery operated lights within light fixture holder 110 can be useful for home or outdoor use. This can be accomplished, for example, by mounting flat lower end 114 onto a support surface and mounting one or more battery operated lights within one or more receiving members 102, 104, 106.

Figure 15:
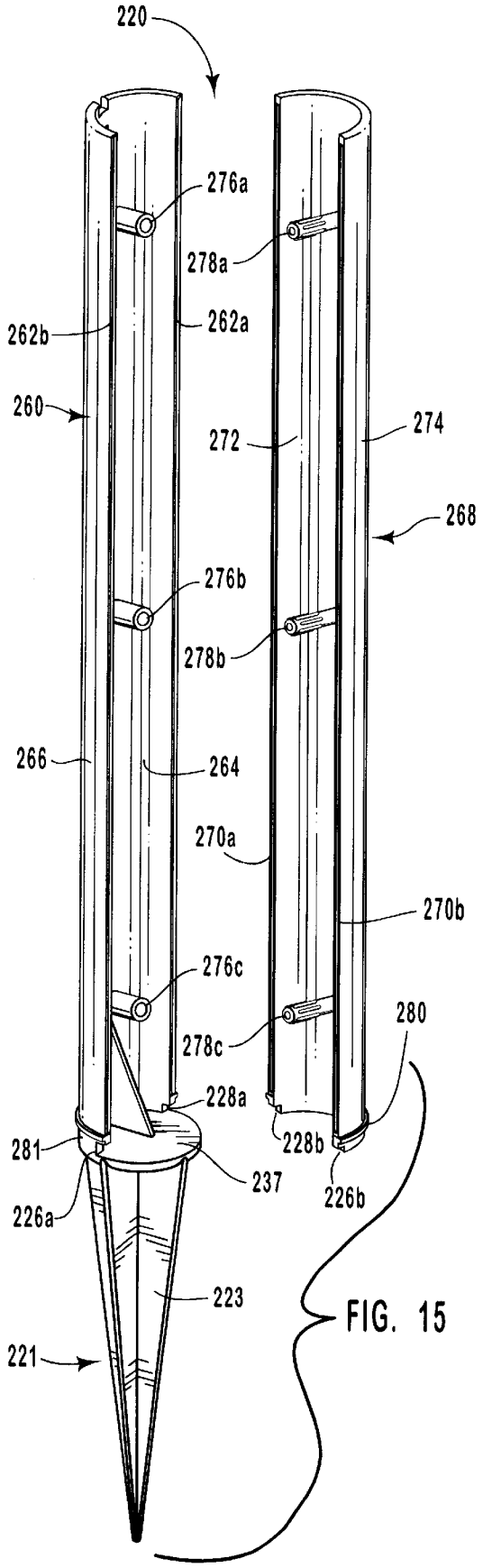
FIG. 15 is an exploded view of a stake shown in FIG. 14.
Figure 16:
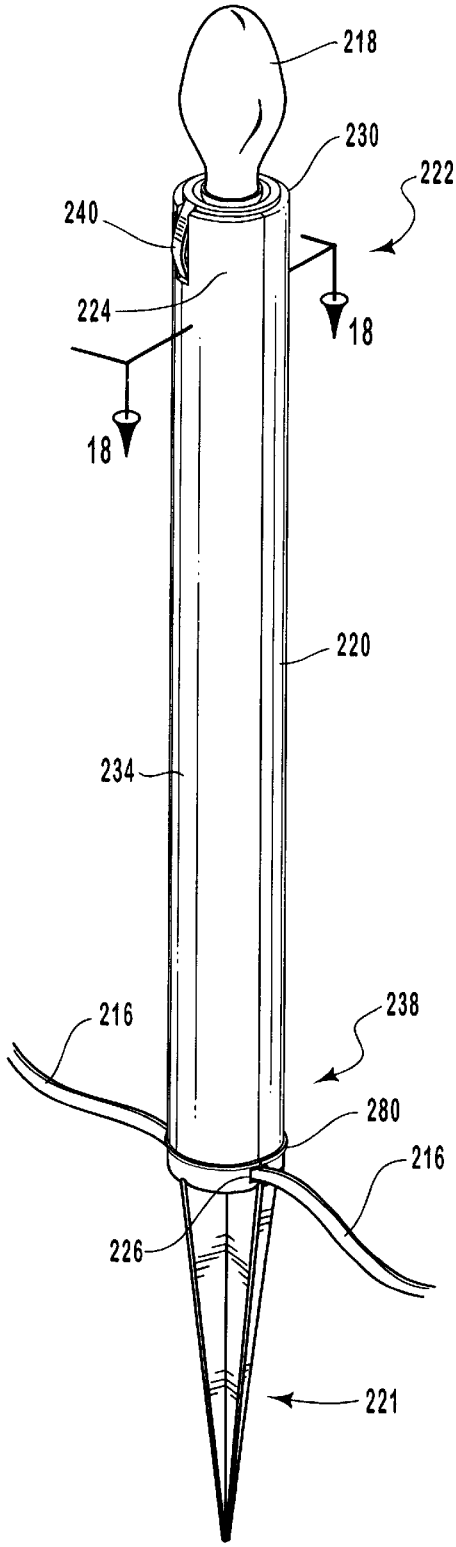
FIG. 16 is a perspective view of the assembled stake of FIG. 14 holding a light fixture therein.
Figure 17:
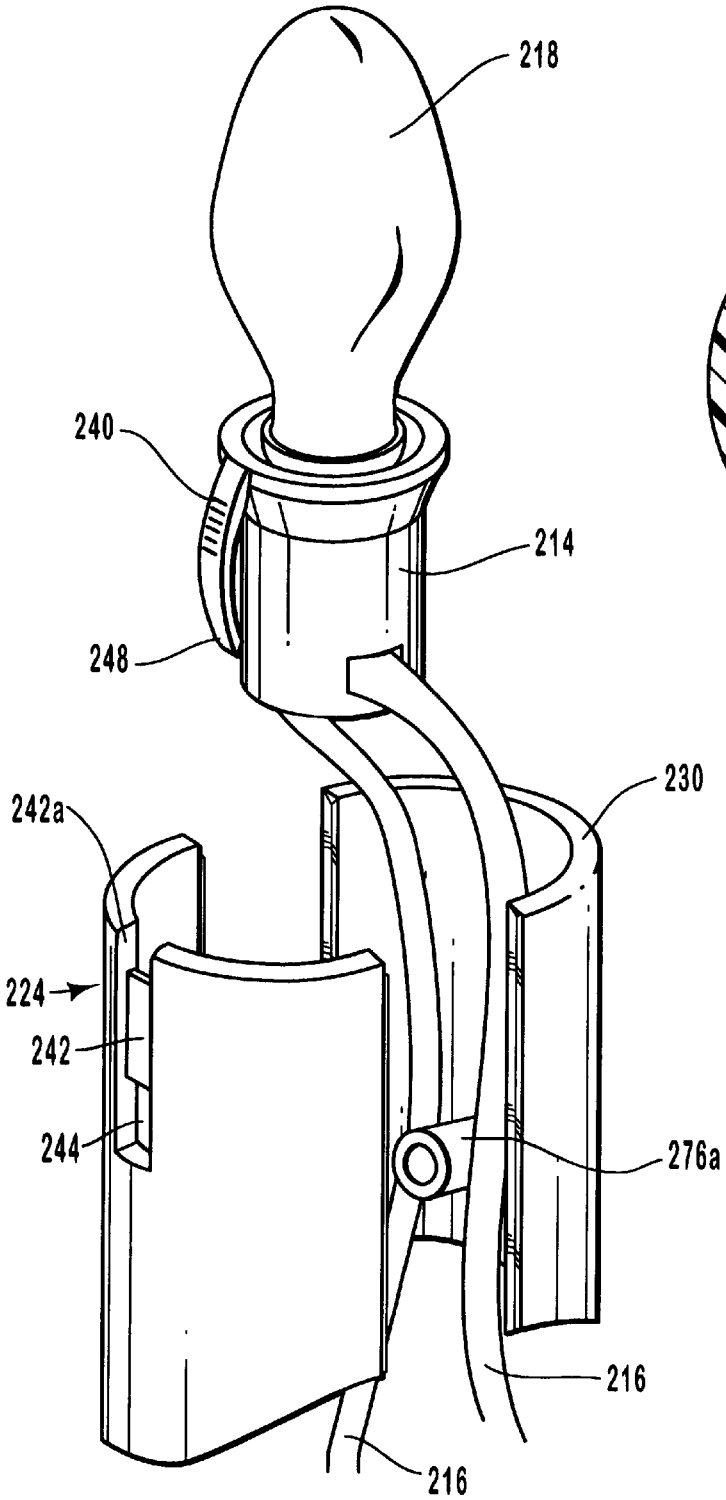
FIG. 17 is a cutaway exploded view of the receiving end of the system shown in FIGS. 14–17 (with the sides grooves of one side replaced with the ridges of an opposing side and vice versa).

Another embodiment of a decorative lighting system 210 for deploying a string 212 of decorative lights above a ground surface 213 is shown in FIGS. 14–20. System 210 comprises a string 212 of lights comprising a plurality of electrical sockets 214 (FIG. 17). Each socket 214 is connected by wiring 216 strung between each of the sockets 214. Each socket 214 receives a light bulb 218 (either integrally or selectively). System 210 further comprises a plurality of separate stake means for holding the plurality of sockets 214. Each stake means holds an individual one of said sockets 214.

With reference to FIGS. 14–18, stake 220 is one example of structure which performs the function of a stake means for holding sockets 214. Stake 220 comprises (i) a sharpened insertion end 221 to facilitate driving stake 220 through the ground surface 213 and into ground 213 to a desired depth; and (ii) a receiving end means for removable insertion of an individual socket 214 therein. Receiving end 222 at the upper end of stake 220 is one example of such a receiving end means for removable insertion of socket 214.

Receiving end 222 comprises a receptacle 224 formed on an upper end of stake 220 which is sized to removably receive one of the sockets 214 of light string 212. For example, in one embodiment, receptacle 224 is sized to receive a socket 214 of light string 212 in a friction fit manner.

Stake 220 also includes means for removably seating and securing wiring 216. One example of a structure for performing the stated function of a means for removably seating and securing wiring 216 comprises at least one and preferably first and second opposing slots 226 (first slot 226 shown in FIG. 16, with the second slot thereof being on an opposing side therefrom). Thus, one or more slots 226 are examples of means for removably seating and securing wiring 216, while other examples are available.

Stake 220 comprises a two piece generally cylindrical body 234 having upper receiving end 222 and lower end 238. Body 234 has a longitudinally extending tubular wall 236 (FIG. 18) extending between upper end 230 of receptacle 224 and a platform 237 of lower end 238. End 221 comprises a sharpened insertion member 223. Sharpened insertion member 223 is coupled to platform 237 and enables insertion end 221 to be conveniently inserted into the ground surface. Member 223 may comprise one or more and preferably four sharpened, symmetrically positioned elongate flanges coupled together, for example, as depicted in FIG. 15 (only three flanges shown in FIG. 15).

Two piece body 234 comprises: (i) a first member 260 having opposing sides 262*a*, 262*b*, an interior surface 264, and an exterior surface 266; and (ii) a second member 268 having opposing sides 270*a*, 270*b* an interior surface 272, and an exterior surface 274. Opposing sides of first and second members 260, 268 selectively mate together to form body 234 with a passageway therein through which wiring can extend. By selectively coupling first and second members 260, 268 together with wiring and a socket therebetween, it is possible to conveniently and effectively maintain one or more light bulbs above a ground surface and within the socket. The two-piece construction is efficient to manufacture and easy to assemble. It may also be uncoupled for storage and/or for replacement of one or more parts. Members 260, 268 may each comprise half pipe portions, as shown, for example.

Figure 18:
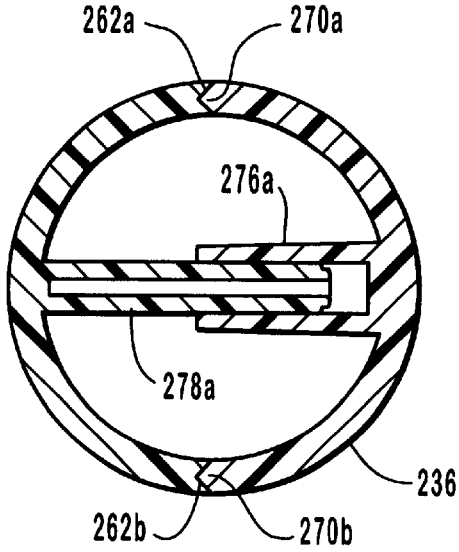
FIG. 18 is a cross sectional view of the assembled stake of FIG. 16.

As depicted in FIGS. 15 and 18, in the embodiment shown, sides 262*a*, 262*b* of first member 260 have grooves therein while sides 270*a*, 270*b* have ridges therein which mate with respective grooves, forming smooth seams on opposing sides of body 234, as shown in FIG. 16. Optionally, (i) the sides of the first member have ridges and the second member has mating grooves, as shown in FIG. 17; or (ii) each member has one groove and one ridge while the other member has corresponding ridges and grooves. In any of these embodiments, the first and second sides of the members can be engaged in interlocking engagement with smooth seams on opposing sides of body 234.

In order to retain corresponding ridges and grooves in interlocking engagement with each other, stake 220 further comprises corresponding male and female engaging members, which are examples of means for selectively coupling the first member to the second member. First member 260 has first, second and third female engaging members 276*a*, 276*b*, 276*c*, while second member 268 has first, second and third male engaging members 278*a*, 278*b*, 278*c* which fit therein in a friction fitting relationship, thereby retaining the ridges of sides 270*a*, 270*b* within the grooves of respective sides 262*a*, 262*b*, forming smooth seams on opposing sides of body 234. Upon placing the male engaging members within the female engaging members, and pressing members into each other until the ridges and grooves of each member mate, a cylindrical body 234 with smooth seams and a passagway for wiring therein is formed.

Slots 226 are conveniently formed through the use of first and second half slot portions on opposing members. Slot 226 shown in FIG. 16 is formed through the use of half slot portions 226*a* and 226*b* in body 234 to form slot 226 when members 260, 268 are coupled together. Half slot portions 228*a* and 228*b* in body 234 also form a slot on an opposing side from slot 226 when members 260, 268 are coupled. In a preferred embodiment, wiring is strung through members 260, 268 with opposing ends of the wiring being disposed, respectively, through opposing slot portions 228*a*/228*b* and 226*a*/226*b*.

Two piece body 234 of stake 220 conveniently allows the placement of wiring 216 through slots 226, 228 and between the opposing members 260, 268 of body 234, such that bulb 218 is conveniently placed into a light socket 214 in receptacle 224 (and while a portion of wiring 216 conveniently extends along the ground level 213). This protects the wiring and provides for a convenient method for placing the wiring and socket within the stake.

In a preferred embodiment, stake 220 comprises polypropylene. In one embodiment, members 260, 268 can be conveniently bent during assembly of stake 220. While assembly can occur in a variety of different manners, in one embodiment, wiring 216 and socket 214 are placed into stake 220 before stake 220 is mounted into the ground.

According, to one such embodiment, which is provided by way of example only, socket 214 is placed into the inside 264 of first member 260 and is secured in place by sliding clip 210 into slot 242*a* iii receptacle 224 (FIG. 17) and clipping clip 240 over mounting tab 242. Tab 242 is thinner than wall 236 of body 234 and is placed below the top of slot 242*a*. Thus, the clip may be conveniently mounted on tab 242 without sacrificing a thicker wall 236 to form the remainder of stake 220, thereby providing stability in the remainder of stake 220. End 248 of clip may be placed against tab 242 or within a portion 244 of slot 242*a* in wall 236 below mounting tab 242. Mounting tab 242, and the portion 244 therebeneath thus allow a user to conveniently mount clip 240 on stake 220.

One embodiment of the method for mounting the socket 214 and wiring within stake 220 further comprises placing the wires within the cavity defined by interior surface 264. This embodiment of the method further comprises securing the second side 268 to the first side 260. This may be accomplished, for example, by first aligning members 278*a–c* with members 276*a–c* and gently pressing them together, thereby partially seating all three members together. Once the members are partially seated, the sides can be firmly snapped closed with opposing wires extending through body 234 and out of opposing slots 226 above platform 237. This can be repeated for all stakes 220 in system 210, loading each of the stakes 220 with respective wiring and sockets. The system 210 can then be placed in ground 213 as desired.

In one embodiment, stakes 220 are placed in the ground 213 approximately 15 inches apart by pressing them into the ground. If the ground is hard, end cap protector 140 of FIG. 13 can be placed over end 222 and stake 220 can be gently tapped into the ground with a rubber mallet, for example. If the ground is extremely hard, a hole may be made first for stake 220 by driving another sharp object into the ground, then inserting stake 220 into the hole. In one embodiment, the light bulbs are then installed into the sockets. In one embodiment, a system extending approximately 75 feet is installed such that approximately 75 feet of power cord source is achieved. Also in one embodiment, the stakes 220 are installed at a uniform alignment, spacing and/or height such that a spectacular lighting effect is achieved.

In one embodiment, stakes 220 are manufactured with ultraviolet (e.g., sunlight) inhibitor to prevent aging. Nevertheless, prolonged direct sunlight may discolor certain systems. Thus, temporary, seasonal use may be preferred in some embodiments. In one embodiment, C-7 size, 5 watt bulbs are employed.

As a major advantage of stake 220, one or more slots 226 are adjacent the sharpened end 221 such that said wiring extends from the socket located at receptacle 224, through body 234 and into one or more slots 226. The sharpened end 221 comprises an insertion member 221 disposed below slots 226 such that the insertion member 221 is placed into the ground surface with the wiring 216 above the ground surface. This protects the wiring from the elements and protects users from tripping on wires and enables convenient insertion of wiring and sockets.

Figure 19:
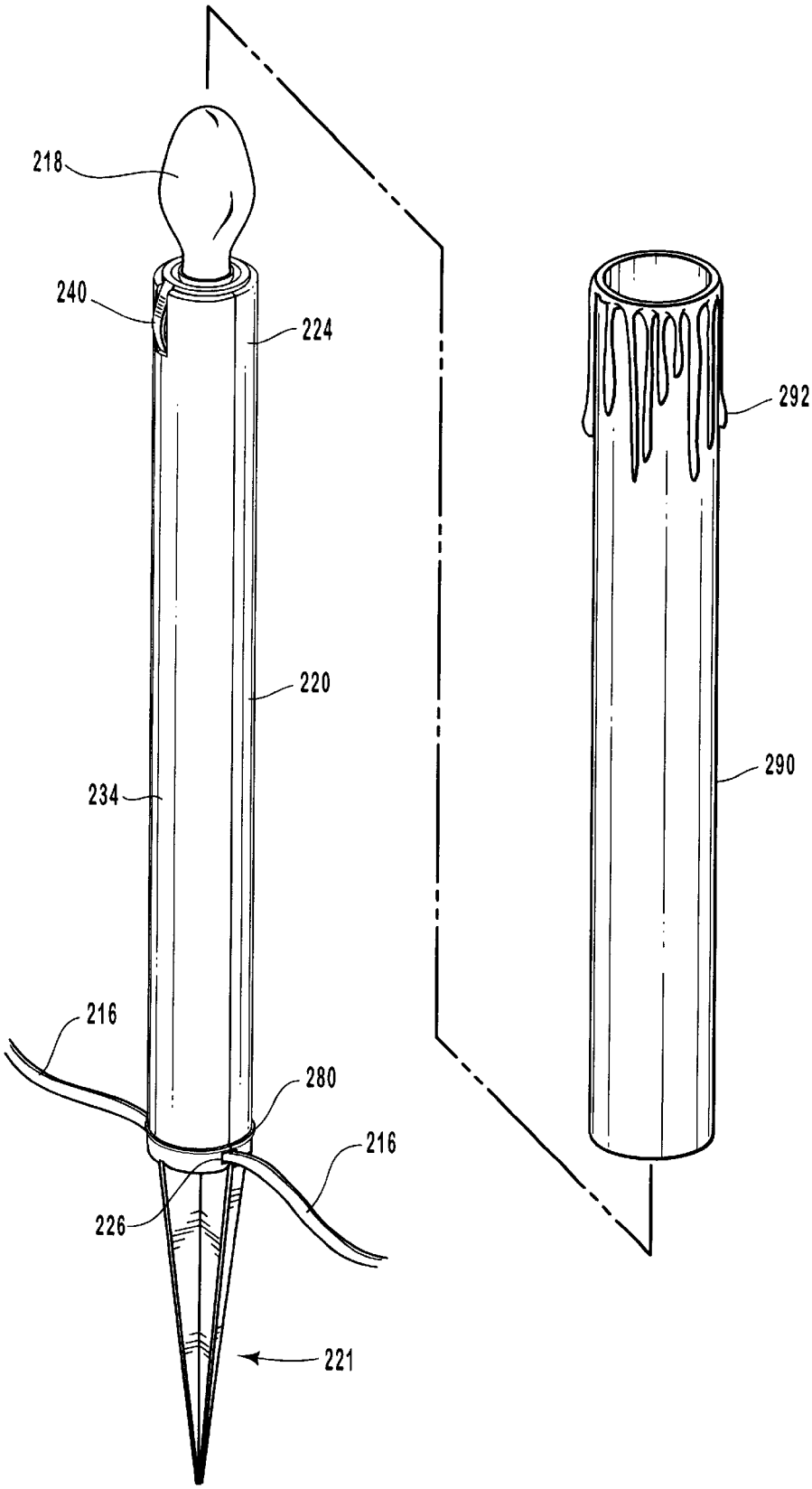
FIG. 19 is an exploded view featuring a sleeve that is selectively placed onto the system of FIGS. 14–18 in order to change the decorative appearance of the stake of the system.
Figure 20:
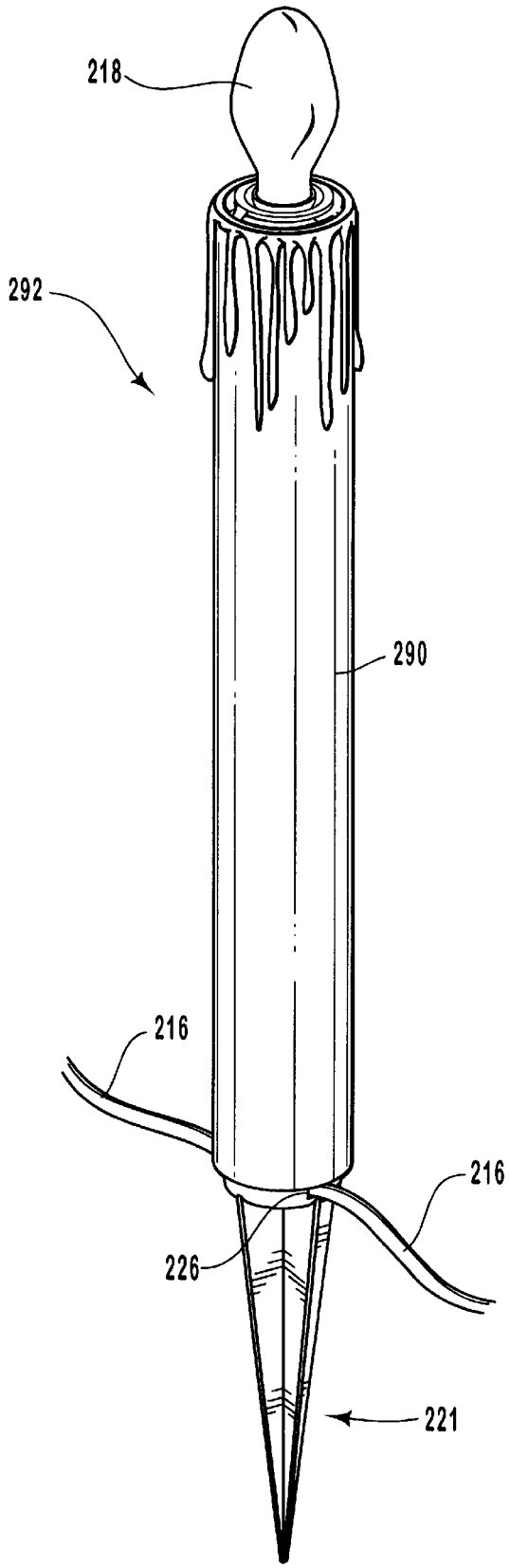
FIG. 20 is an assembled view of the system shown in FIG. 19 with the sleeve mounted thereon.

As shown in FIGS. 15 and 16, in one embodiment of the present invention, stake 220 includes a mounting ledge 280 extending about body 234. Mounting ledge 280 may be employed to receive a sleeve 290 thereon, as shown in FIGS. 19 and 20. Sleeve 290 is selectively coupled to stake 220, as shown. Sleeve 290 comprises a hollow sleeve, such as a piece of pipe comprising polypropylene or another material. Sleeve 290 may have a decorative material 292 at a top portion thereof, simulating the look of wax, for example. Material 292 may be a material which is integral with sleeve 290, for example, or may be coupled thereto, such as through blow molding, for example. In one embodiment sleeve 290 and material 292 are molded as an integral unit, for example.

Sleeve 290 may have a different color from body 234, for example. For instance, sleeve 290 may be white, while body 234 is black. According to one holiday tradition, the black body 234 may be employed during Halloween, while the white sleeve 290 is placed on the black body 234 to have the appearance of a white candlestick, for example. Thus, hollow sleeve 290 may be employed to cover a particular cover of body 234 and change the appearance of stake 220, for example.

In yet another embodiment of the present invention, rather than employing first and second separate sides, as shown in FIGS. 14–20 the stake of present invention comprises a hollow, unitary body, similar to FIG. 10, for example, yet features the insertion end 221 and opposing slots 226 of FIGS. 14–20. This embodiment may be manufactured with wiring 216 and socket 240 premounted within the stake, for instance.

Figure 21:
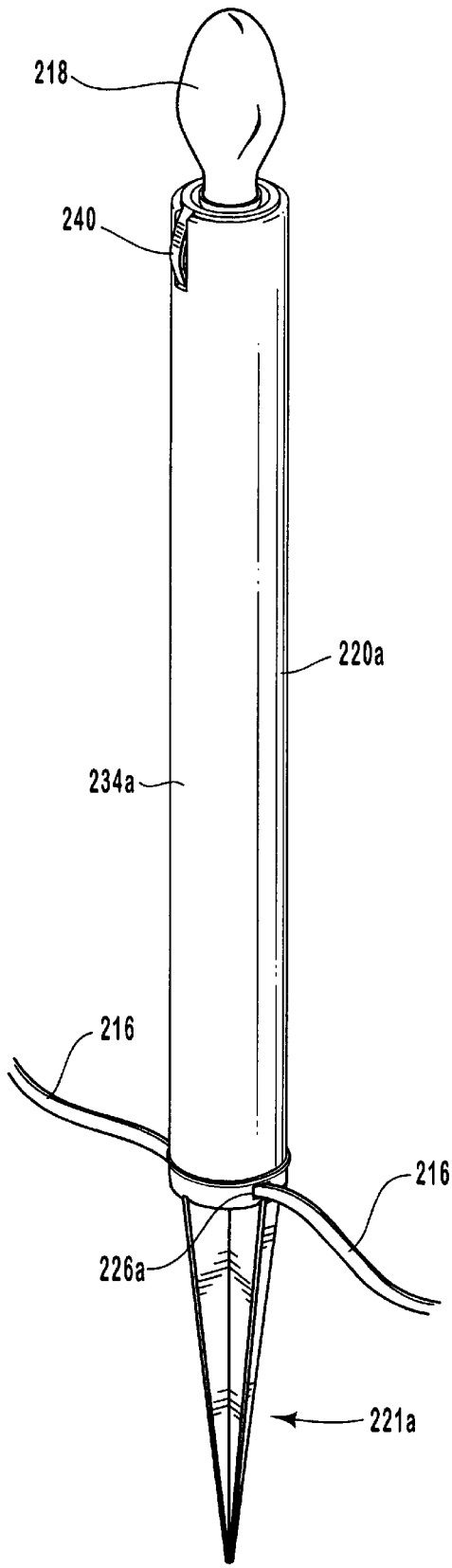
FIG. 21 is an alternative embodiment of a stake formed as a unitary, one piece hollow body with wires extending from slots thereof and with a light bulb mounted in a socket electrically coupled to the wires.

An example of such an embodiment of a stake 220*a* is shown in FIG. 21, featuring hollow, one piece body 234*a* with opposing lower slots 226*a* and insertion end 221*a* coupled to the lower end of the one piece body 234*a*. For example, insertion end 221*a* may be coupled to a platform similar to platform 237, but having walls extending integrally and upwardly therefrom in a one piece cylindrical shape, as shown in FIG. 21, for example. Body 234*a* may be hollow and one piece and does not necessarily need internal engaging members to retain different members thereof together. In one embodiment, stake 220*a* is injection or insertion molded onto wiring 216 and a socket electrically coupled to wiring 216, for example.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A decorative lighting system for deploying a string of decorative lights above a ground surface, comprising:

a string of decorative lights comprising a plurality of electrical sockets each connected by wiring strung between each of the sockets, each socket receiving a light bulb; and a plurality of separate stake means for holding the plurality of sockets, each stake means comprising, insertion means, formed at one end of the stake means, for facilitating placement of the stake means by driving the stake means through the ground surface and into the ground, and cylindrical body comprised of first and second members which are selectively coupleable to one another to facilitate placement of wiring through the center of said cylindrical body, one of said members being joined to said insertion means as an integral part thereof, the other of said members being separate from said insertion means, and when uncoupled, said members permitting placement of said wiring through the interior of the unassembled cylindrical body, and when coupled, said members together forming said cylindrical body by their assembly, so as to form at one end thereof a receiving end means for receiving an individual socket, the opposite end of said assembled cylindrical body being seated upon and supported by said insertion means so that the assembled stake means can then be driven into the ground.

2. A system as recited in claim 1, further comprising means for selectively coupling the first member to the second member.

3. A system as recited in claim 2, wherein the means for selectively coupling the first member to the second member comprises one member having a female engaging member and the opposing member having a male engaging member, the male engaging member selectively engaging the female engaging member.

4. A decorative lighting system as defined in claim 1, further comprising a sleeve selectively coupled to the stake means to selectively alter the appearance of the stake means.

5. A system as recited in claim 4, wherein the stake means has a ledge for selectively mounting the sleeve thereon.

6. A system as recited in claim 1, wherein said first and second members when selectively coupled together, form a unitary body with said wiring and said socket therebetween.

7. A decorative lighting system as defined in claim 6, wherein the first and second members are selectively coupled to each other with smooth seams on opposing sides of the uniform body.

8. A decorative lighting system as defined in claim 6, further comprising a means for removably seating and securing said wiring and which comprises at least one slot, the slot being formed from a half slot portion in each member.

9. A decorative lighting system as recited in claim 6, wherein the first and second members comprise mating ridges and grooves on the sides thereof to thereby form a smooth unitary body.

10. A system is recited in claim 1, further comprising a mounting tab located in the receiving end means to thereby selectively couple a clip of the socket to the stake means, the mounting tab positioned within a slot below the top of the slot.

11. A system as recited in claim 10, wherein the mounting tab is located above the lower end of slot.

12. A system as recited in claim 11, wherein the mounting tab is thinner than a wall of the stake means.

13. A decorative lighting system for deploying a string of decorative lights above a ground surface, comprising:

at string of decorative lights comprising a plurality of electrical sockets each connected by wiring strung between each or the sockets, each socket receiving a light bulb; and a plurality or separate stake assemblies, each comprising, a sharpened insertion member coupled to a generally flat platform, the sharpened insertion member facilitating placement of an assembled stake by permitting it to be driven through the ground surface and into the ground generally to the point of said flat platform, and a generally cylindrical body comprised of first and second members which are selectively coupleable to one another to facilitate placement of wiring through the center of said cylindrical body when it is unassembled, one of said members being joined to said sharpened insertion member as an integral part thereof, the other of said members being separate from said insertion means, and when coupled, said members together forming said cylindrical body by their assembly, so as to form at one end thereof an end for receiving an individual socket, the opposite and of said assembled cylindrical body being seated upon and supported by said generally flat platform coupled to said sharpened insertion member, so that the assembled stake can then be driven into the ground.

14. A decorative lighting system as defined in claim 13 wherein said receptacle is sized to receive a socket of the string of lights in a friction fit manner.

15. A decorative light system as recited in claim 13, wherein a female engaging member selectively engages a male engaging member to selectively couple the first member to the second member, the first and second members being selectively coupled to each other with smooth seams on opposing, sides so as to thereby form a uniform body.

16. A decorative lighting system as defined in claim 13, further comprising a sleeve selectively coupled to the stake to selectively alter the appearance of the stake and wherein the stake has a ledge for selectively mounting the sleeve thereon.

17. A decorative lighting system as defined in claim 13, further comprising, a first slot that seats and secures said wiring, the first slot located adjacent the platform coupled to the sharpened insertion member, such that said wiring extends from the socket on said string of lights located at said receptacle, through said assembled cylindrical body, and out said first slot, and a second slot located at said receptacle.

18. A system as recited in claim 17, further comprising a mounting tab located in the receptacle to thereby selectively couple a clip of the socket to the stake, the mounting tab positioned within said second slot below the top of the receptacle and wherein the mounting tab is thinner than a wall of the receptacle.

* * * * *